US010961673B2

(12) United States Patent
Nejati

(10) Patent No.: US 10,961,673 B2
(45) Date of Patent: Mar. 30, 2021

(54) RETRACTABLE SPEED BUMP AND A METHOD FOR RETRACTING A SPEED BUMP

(71) Applicant: Abbas Nejati, Kashan (IR)

(72) Inventor: Abbas Nejati, Kashan (IR)

( * ) Notice: Subject to any disclaimer, the term of this patent is extended or adjusted under 35 U.S.C. 154(b) by 0 days.

(21) Appl. No.: 16/209,952

(22) Filed: Dec. 4, 2018

(65) Prior Publication Data

US 2019/0106849 A1 Apr. 11, 2019

Related U.S. Application Data

(60) Provisional application No. 62/594,022, filed on Dec. 4, 2017.

(51) Int. Cl.
*E01F 9/529* (2016.01)
*E01F 13/04* (2006.01)

(52) U.S. Cl.
CPC ..... *E01F 13/046* (2013.01); *E01F 9/529* (2016.02)

(58) Field of Classification Search
CPC ..... E01F 15/00; E01F 15/529; E01F 9/529
USPC ..... 404/11, 15
See application file for complete search history.

(56) References Cited

U.S. PATENT DOCUMENTS 2,559,968 A * 7/1951 Katz ..... F16F 9/50 188/282.7
2,792,914 A * 5/1957 Benard ..... F16F 9/3214 188/277
3,605,801 A * 9/1971 De Carbon ..... F16F 9/3405 137/513.7
4,342,525 A * 8/1982 Mastronuzzi, Jr. ..... E01F 9/529 404/6
4,721,130 A * 1/1988 Hayashi ..... F16F 9/3485 137/493.8
5,570,763 A * 11/1996 Parejo ..... F16F 9/3214 188/282.8
5,738,190 A * 4/1998 Deferme ..... F16F 9/348 137/513.3
5,823,306 A * 10/1998 de Molina ..... F16F 9/34 188/322.15
6,010,277 A * 1/2000 Follman ..... E01F 9/529 404/10

(Continued)

FOREIGN PATENT DOCUMENTS

GB 2266552 A * 11/1993 ..... E01F 9/529
WO WO-2018167548 A1 * 9/2018 ..... E01F 9/529

*Primary Examiner* — Thomas B Will
*Assistant Examiner* — Katherine J Chu
(74) *Attorney, Agent, or Firm* — Bajwa IP Law Firm; Haris Zaheer Bajwa

(57) ABSTRACT

A retractable speed bump and a method for retracting a speed bump. The retractable speed bump may include a retractile element, a chassis, and a hydraulic mechanism. The hydraulic mechanism may include a hydraulic cylinder including a hollow cylindrical shape, a hydraulic piston including a solid cylindrical shape, a first connecting rod, an oil sealing member, a return spring, a spring retainer, and a floating gasket. Responsive to downward movement of the first connecting rod at a speed higher than a threshold, the hydraulic cylinder may prevent downward movement of the first connecting rod and responsive to downward movement of the first connecting rod at a speed lower than the threshold, the hydraulic cylinder may allow downward movement of the first connecting rod.

3 Claims, 14 Drawing Sheets

(56) References Cited

U.S. PATENT DOCUMENTS

| | | | | |
|---|---|---|---|---|
| 6,311,813 | B1 * | 11/2001 | Lauderbach | F16F 9/0218 188/322.16 |
| 6,457,900 | B2 * | 10/2002 | Bond | E01F 9/529 404/15 |
| 6,726,399 | B2 * | 4/2004 | Heeks | F16K 17/048 404/15 |
| 7,004,193 | B2 * | 2/2006 | Heeks | F16K 17/048 137/512.2 |
| 7,011,470 | B1 * | 3/2006 | Breazeale | E01F 9/529 404/10 |
| 7,476,052 | B2 * | 1/2009 | Hall | E01F 9/529 404/15 |
| 8,333,270 | B2 * | 12/2012 | Ji | F16F 9/5126 188/282.8 |
| 8,360,751 | B2 * | 1/2013 | Duncan | F04B 5/00 166/108 |
| 8,474,845 | B2 * | 7/2013 | Souschek | |
| 9,410,297 | B2 * | 8/2016 | Ustrell I Mussons | E01C 9/00 |
| 9,689,121 | B2 * | 6/2017 | Shi | E01F 9/529 |
| 9,784,332 | B2 * | 10/2017 | Bandy | F16F 9/067 |
| 10,072,722 | B2 * | 9/2018 | Bandy | F16F 9/067 |
| 10,280,999 | B2 * | 5/2019 | Svara | E05F 5/10 |
| 10,480,605 | B2 * | 11/2019 | Ruhlman | F16F 9/368 |
| 2005/0031411 | A1 * | 2/2005 | Hensley | E01F 13/046 404/11 |
| 2009/0078518 | A1 * | 3/2009 | Gagnon | F16F 9/48 188/315 |
| 2012/0191102 | A1 * | 7/2012 | Matsumoto | A61B 17/8822 606/94 |
| 2014/0227031 | A1 * | 8/2014 | Fifi | E01F 9/529 404/15 |
| 2015/0176232 | A1 * | 6/2015 | Ustrell I Mussons | E01C 9/00 404/10 |
| 2018/0362006 | A1 * | 12/2018 | Weh | B60T 8/409 |

* cited by examiner

400

402

404

RETRACTABLE SPEED BUMP AND A METHOD FOR RETRACTING A SPEED BUMP

CROSS-REFERENCE TO RELATED APPLICATION

This application claims the benefit of priority from U.S. Provisional Patent Application Ser. No. 62/594,022 filed on Dec. 4, 2017, and entitled "FOLDABLE SPEED BUMP" which is incorporated herein by reference in its entirety.

TECHNICAL FIELD

The present disclosure generally relates to speed bump systems, and particularly to a retractable speed bump that when an automobile pass thereon with allowed speed, it retracts.

BACKGROUND

In the interest of safety to other vehicles and nearby pedestrians, the speed of motorized vehicles should be kept to a safe level. Excessive vehicular speed, especially on roads through residential areas and in parking lots, create a dangerous environment for drivers and pedestrians alike. To that end, speed limits are posted on roads, with the local speed limit being dependent on the type and location of the road. Unfortunately, many drivers disregard these posted speed limits.

Other methods, which drivers cannot disregard, are employed on some roads to keep the speed of vehicles at a safe level. It is common for speed bumps to be placed across roads in neighborhoods, parking lots, and other area where it is desirable to ensure that vehicle speeds are limited. Such speed bumps are usually elongated and mounted areas of asphalt or cement that traverse the width of the road, or the width of a driving area of a parking lot, to ensure that each vehicle encounters the speed bump. The speed bumps are usually painted or physically treated in some manner to alert drivers to the presence of the speed bump.

The dimensions of the speed bumps are, generally, such that a vehicle must slow down to a lower speed to pass over the speed bump without jarring the vehicle. Passing over a speed bump at a higher speed, as is known for many drivers, causes a very undesirable jolt to the vehicle and its occupants. In this manner, speed bumps cause drivers to slow down to a low speed to pass over the speed bump.

Speed bumps are typically installed at intermittent locations along a road or parking lot, but close enough to each other so that vehicles traveling between adjacent speed bumps do not have enough linear road space to accelerate to an unsafe speed, considering the low speed to which the vehicle has to slow down to pass over the speed bumps. The speed bumps can be spaced apart by any desired distance, which usually depends on the type, shape, and location of the road. For example, speed bumps in a parking lot should be placed relatively close together to drastically limit the speed of vehicles to perhaps 10 mph, but speed bumps on a residential street can be placed further apart to limit the speed of vehicles to perhaps 20 mph or 30 mph. Therefore, speed bumps prevent vehicles from traveling at unsafe speeds along an expanse of a road, in a parking lot, or other driving areas.

However, such speed bumps can be very inconvenient and frustrating because they do not discriminate between vehicles driving at different speeds. Speed bumps are, generally, installed to urge drivers traveling too fast to slow to a lower speed to pass over the speed bump. However, drivers that already are traveling at a safe speed do not need the added deterrent of the speed bump to maintain their vehicles at a safe speed. Therefore, although a speed bump is necessary to slow down a fast driver, the speed bump is not necessary and may be a nuisance, for a slower, safer driver who does not exceed the speed limit.

Therefore, speed bumps indiscriminately affect all drivers, even those traveling at a safe speed. This indiscriminate effect on vehicles traveling over speed bumps has caused many people to be opposed to the installation of speed bumps where they are otherwise needed, thereby contributing to an unsafe environment for other drivers on the road and nearby pedestrians. There is, therefore, a need for an automatic retractable speed bump that is operative based on the speed of the vehicle that contacts the speed bump. There is also a need for an automatic speed bump that provides a bump for vehicles that encounter the speed bump traveling over a predetermined speed, but does not provide a bump for vehicles traveling below the determined speed.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments, the present disclosure describes an exemplary retractable speed bump. In an exemplary embodiment, the retractable speed bump may include a retractile element, a chassis, and a hydraulic mechanism. In an exemplary embodiment, the retractile element may include a raised surface in shape of a triangular surface or a curved surface. In an exemplary embodiment, the retractile element may be mounted on the chassis through a first pin mechanism.

In an exemplary embodiment, the hydraulic mechanism may be connected to the retractile element through a second pin mechanism. In an exemplary embodiment, the hydraulic mechanism may include a hydraulic cylinder, a hydraulic piston, and a floating gasket. In an exemplary embodiment, the hydraulic cylinder may have a hollow cylindrical shape. In an exemplary embodiment, the hydraulic piston may be connected to the retractile element through a connecting rod. In an exemplary embodiment, the hydraulic piston may have a solid cylindrical shape. In an exemplary embodiment, the hydraulic piston may be disposed slidably inside the hydraulic cylinder.

In an exemplary embodiment, the floating gasket may have a disk shape. In an exemplary embodiment, the floating gasket may be disposed slidably inside the hydraulic cylinder. In an exemplary embodiment, the floating gasket may define a fluid gap between the floating gasket and an interior surface of the hydraulic cylinder.

In an exemplary embodiment, the hydraulic mechanism may be configured to allow retracting the speed bump responsive to a vehicle passing over the speed bump slower than a first threshold speed. In an exemplary embodiment, the hydraulic mechanism may be further configured to allow retracting the speed bump responsive to a vehicle passing over the speed bump faster than the first threshold speed.

In an exemplary embodiment, the hydraulic cylinder may be filled with hydraulic oil. In an exemplary embodiment, the hydraulic piston may include a plurality of longitudinal through holes along a main longitudinal axis of the hydraulic piston. In an exemplary embodiment, the plurality of longitudinal through holes may be configured to provide the hydraulic oil communication between an upper section of the hydraulic cylinder and a lower section of the hydraulic cylinder.

In an exemplary embodiment, the upper section of the hydraulic cylinder may be located at an upper side of the hydraulic piston. In an exemplary embodiment, the lower section of the hydraulic cylinder may be located at a lower side of the hydraulic piston.

In an exemplary embodiment, responsive to a vehicle passing over the speed bump slower than the first threshold speed. In an exemplary embodiment, the connecting rod may urge the hydraulic piston sliding downward slower than a second threshold speed. In an exemplary embodiment, responsive to the hydraulic piston sliding downward slower than a second threshold speed, the floating gasket may maintain float in the lower section of the hydraulic cylinder.

In an exemplary embodiment, responsive to the floating gasket maintaining float in the lower section of the hydraulic cylinder, the hydraulic oil communication between the upper section of the hydraulic cylinder and the lower section of the hydraulic cylinder through the plurality of longitudinal through holes may allow the hydraulic piston sliding downward. In an exemplary embodiment, responsive to the hydraulic piston sliding downward, the retractile element may retract.

In an exemplary embodiment, responsive to a vehicle passing over the speed bump faster than the first threshold speed, the connecting rod may urge the hydraulic piston sliding downward faster than the second threshold speed. In an exemplary embodiment, responsive to the hydraulic piston sliding downward faster than the second threshold speed, the floating gasket may stick to a bottom face of the hydraulic piston.

In an exemplary embodiment, sticking the floating gasket to the bottom face of the hydraulic piston may cause blocking the hydraulic oil communication between the up side of the hydraulic piston and the down side of the hydraulic piston by blocking the plurality of longitudinal hoes. blocking the hydraulic oil communication between the up side of the hydraulic piston and the down side of the hydraulic piston may prevent the hydraulic piston sliding downward. In an exemplary embodiment, responsive to preventing the hydraulic piston sliding downward, the retractile element may maintain raised.

In an exemplary embodiment, the hydraulic mechanism may include a return spring disposed on a bottom end of the hydraulic cylinder. In an exemplary embodiment, the hydraulic mechanism may include a spring retainer mounted onto the return spring. In an exemplary embodiment, the return spring and the spring retainer may be configured to raise the hydraulic piston to a first position of the hydraulic piston.

In an exemplary embodiment, raising the hydraulic piston to a first position of the hydraulic piston may raise the retractile element to an initial position of the retractile element. In an exemplary embodiment, responsive to removing the vehicle force exerted onto the retractile element, the return spring and the spring retainer may raise the hydraulic piston to the first position of the hydraulic piston.

In an exemplary embodiment, the hydraulic cylinder may include an upper section of the hydraulic cylinder and a lower section of the hydraulic cylinder. In an exemplary embodiment, the upper section of the hydraulic cylinder may be located at an upper side of the hydraulic piston. In an exemplary embodiment, the lower section of the hydraulic cylinder may be located at a lower side of the hydraulic piston.

In an exemplary embodiment, the hydraulic cylinder may include a hollow wall. In an exemplary embodiment, the hollow wall may define a shell oil reservoir.

In an exemplary embodiment, the shell oil reservoir may be in hydraulic oil communication with the upper section of the hydraulic cylinder through a first hole. In an exemplary embodiment, the shell oil reservoir may be in hydraulic oil communication with the upper section of the hydraulic cylinder through a second hole.

In an exemplary embodiment, responsive to a vehicle passing over the speed bump slower than the first threshold speed, the connecting rod may urge the hydraulic piston sliding downward slower than a second threshold speed. In an exemplary embodiment, responsive to the hydraulic piston sliding downward slower than the second threshold speed, the floating gasket may maintain float in the down side of the hydraulic piston.

In an exemplary embodiment, responsive to the floating gasket maintaining float in the down side of the hydraulic piston, the hydraulic oil communication between the upper section of the hydraulic cylinder and the lower section of the hydraulic cylinder through the first hole, the second hole, and the shell oil reservoir may allow the hydraulic piston sliding downward. In an exemplary embodiment, responsive to the hydraulic piston sliding downward, the retractile element may retract.

In an exemplary embodiment, responsive to a vehicle passing over the speed bump faster than the first threshold speed, the connecting rod may urge the hydraulic piston sliding downward faster than the second threshold speed. In an exemplary embodiment, responsive to the hydraulic piston sliding downward faster than the second threshold speed, the floating gasket may stick to a bottom end of the hydraulic cylinder.

In an exemplary embodiment, sticking the floating gasket to the bottom end of the hydraulic cylinder may block the hydraulic oil communication between the upper section of the hydraulic cylinder and the lower section of the hydraulic cylinder by blocking the first hole. In an exemplary embodiment, responsive to blocking the first hole, the hydraulic piston may slide downward. In an exemplary embodiment, responsive to the hydraulic piston sliding downward, the retractile element may maintain raised.

In an exemplary embodiment, the hydraulic mechanism may further include a return spring disposed on a bottom end of the hydraulic cylinder. In an exemplary embodiment, the floating gasket may be mounted onto the return spring. In an exemplary embodiment, the return spring may be configured to raise the hydraulic piston to a first position of the hydraulic piston. In an exemplary embodiment, responsive to raising the hydraulic piston to the first position of the hydraulic piston, the retractile element may be raised to an initial position of the retractile element. In an exemplary embodiment, responsive to removing the vehicle force exerted onto the retractile element, the hydraulic piston may be raised to a first position of the hydraulic piston.

According to one or more exemplary embodiments, the present disclosure describes an exemplary method for retracting an exemplary speed bump. In an exemplary embodiment, the speed bump may include a top protruded part. In an exemplary embodiment, the method may include retracting the top protruded part of the speed bump responsive to a vehicle passing over the speed bump slower than a threshold speed.

In an exemplary embodiment, the top protruded part of the speed bump may be connected to a hydraulic mechanism by a connecting rod. In an exemplary embodiment, retracting the top protruded part of the speed bump responsive to the vehicle passing over the speed bump slower than a threshold speed may include receiving a first downward force at the top protruded part of the speed bump from a vehicle passing over the speed bump slower than a threshold speed.

In an exemplary embodiment, retracting the top protruded part of the speed bump responsive to the vehicle passing over the speed bump slower than a threshold speed may further include urging a hydraulic piston of the hydraulic mechanism to move downward inside a hydraulic cylinder at a speed proportional to the vehicle speed utilizing the connecting rod transferring the first downward force to the hydraulic piston.

In an exemplary embodiment, retracting the top protruded part of the speed bump responsive to the vehicle passing over the speed bump slower than a threshold speed may further include moving the hydraulic piston downward inside the hydraulic cylinder by providing hydraulic oil communication between an upper side of the hydraulic cylinder and a lower side of the hydraulic cylinder.

In an exemplary embodiment, the disclosed method may further include maintaining a position of the top protruded part of the speed bump responsive to a vehicle passing over the speed bump faster than a threshold speed. In an exemplary embodiment, maintaining the position of the top protruded part of the speed bump may include receiving a second downward force at the top protruded part of the speed bump from the vehicle passing over the speed bump faster than the threshold speed.

In an exemplary embodiment, maintaining the position of the top protruded part of the speed bump may further include urging the hydraulic piston of the hydraulic mechanism move downward inside a hydraulic cylinder at a speed proportional to the vehicle speed. In an exemplary embodiment, maintaining the position of the top protruded part of the speed bump may further include urging the hydraulic piston of the hydraulic mechanism move downward inside a hydraulic cylinder at a speed proportional to the vehicle speed utilizing the connecting rod transferring the second downward force to the hydraulic piston.

In an exemplary embodiment, maintaining the position of the top protruded part of the speed bump may further include preventing the hydraulic piston downward movement inside the hydraulic cylinder by blocking hydraulic oil communication between the upper side of the hydraulic cylinder and the lower side of the hydraulic cylinder.

In an exemplary embodiment, the hydraulic mechanism may include a hydraulic cylinder, a hydraulic piston, and a floating gasket. In an exemplary embodiment, the hydraulic cylinder may have a hollow cylindrical shape. In an exemplary embodiment, the hydraulic piston may be connected to the retractile element through a connecting rod. In an exemplary embodiment, the hydraulic piston may have a solid cylindrical shape. In an exemplary embodiment, the hydraulic piston may be disposed slidably inside the hydraulic cylinder.

In an exemplary embodiment, the floating gasket may have a disk shape. In an exemplary embodiment, the floating gasket may be disposed slidably inside the hydraulic cylinder. In an exemplary embodiment, the floating gasket may define a fluid gap between the floating gasket and an interior surface of the hydraulic cylinder.

In an exemplary embodiment, the method may further include raising the top protruded part of the speed bump to an initial position of raising the top protruded part of the speed bump. In an exemplary embodiment, raising the top protruded part of the speed bump to an initial position of raising the top protruded part of the speed bump may be done by raising the hydraulic piston to a first position of the hydraulic piston responsive to removing the vehicle force exerted onto the retractile element.

In an exemplary embodiment, raising the top protruded part of the speed bump to an initial position of the top protruded part of the speed bump by raising the hydraulic piston to a first position of the hydraulic piston may include raising the top protruded part of the speed bump to an initial position of the top protruded part of the speed bump by raising the hydraulic piston to a first position of the hydraulic piston utilizing a return spring. In an exemplary embodiment, the return spring may be disposed on a bottom end of the hydraulic cylinder, and the floating gasket may be mounted onto the return spring.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1A:
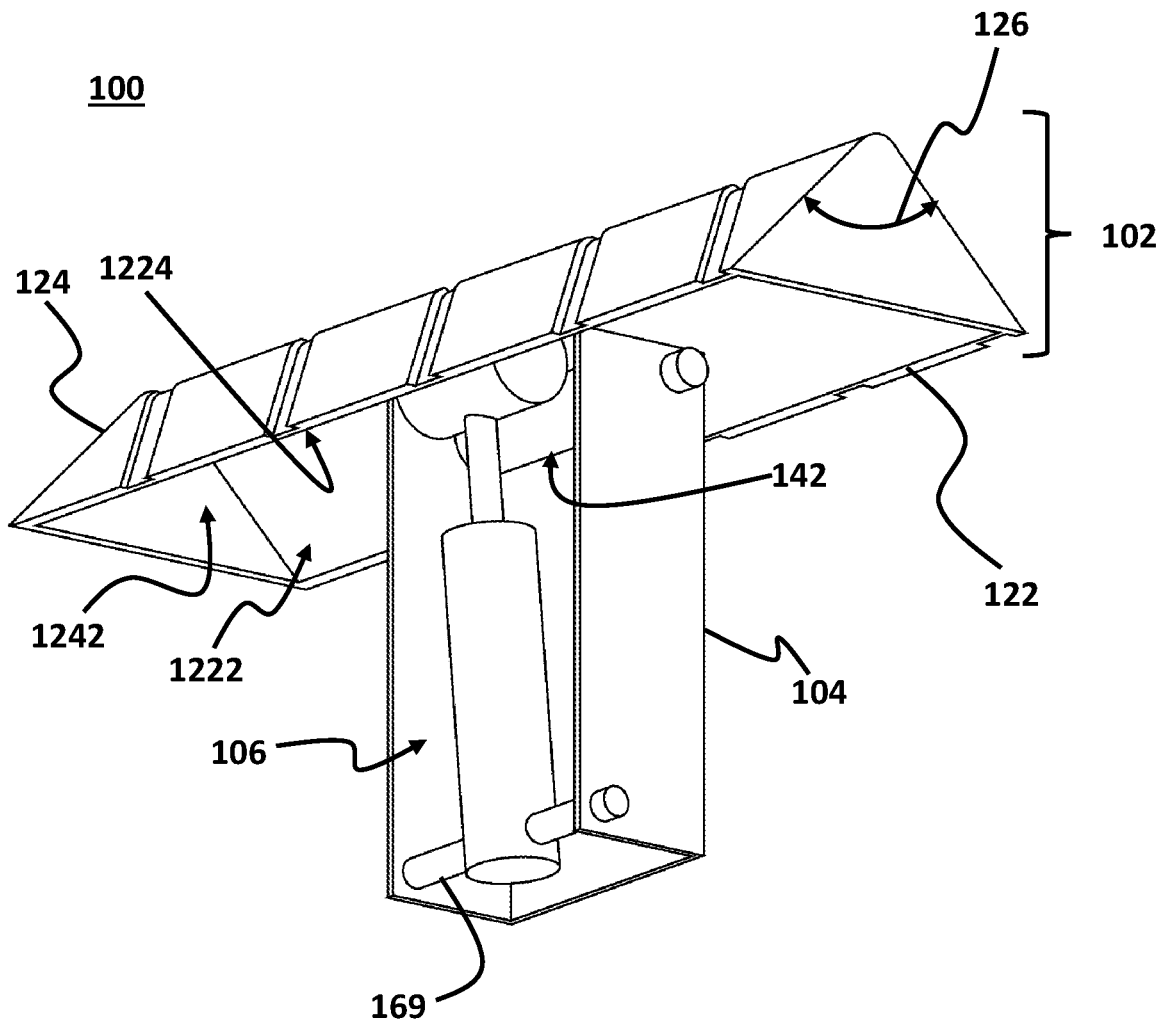
FIG. 1A illustrates a perspective view of a retractable speed bump, consistent with one or more exemplary embodiments of the present disclosure.

In the following detailed description, numerous specific details are set forth by way of examples in order to provide a thorough understanding of the relevant teachings. However, it should be apparent that the present teachings may be practiced without such details. In other instances, well-known methods, procedures, components, and/or circuitry have been described at a relatively high-level, without detail, in order to avoid unnecessarily obscuring aspects of the present teachings. The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown but is to be accorded the widest possible scope consistent with the principles and features disclosed herein.

The present disclosure is directed to exemplary retractable speed-sensitive speed bumps mounted in a street, road or roadway for controlling the speed of vehicles. The exemplary speed bump provides a speed-sensitive mechanism that allows the exemplary speed bump to maintain in a raised position when impacted by a vehicle tire traveling at a speed at or above a predetermined speed. On the other side, when the vehicle is traveling below the predetermined speed, the exemplary speed bump provides a facility to allow the exemplary speed bump collapses to a horizontal position such that the vehicle does not experience a bump.

The exemplary speed bump may have a triangular-shaped or curved-shaped top ramp that may be installed in the street and it may be seen by for example vehicle drivers when it is in the raised position. The exemplary speed bump may also include a hydraulic assembly that may be responsible to allow the top ramp to be retracted when the approaching vehicle is traveling at a speed below a predetermined speed. When the exemplary speed bump is in the raised position and a vehicle approaches the exemplary speed bump with a speed below the predetermined speed, contacting a wheel of a vehicle with the ramp may cause the hydraulic piston of the hydraulic assembly to move down and consequently the top ramp may be retracted. When the exemplary speed bump is in the raised position and a vehicle approaches the exemplary speed bump with a speed above the predetermined speed, the fluid communication between two sides of the hydraulic piston may be blocked and consequently the top ramp may maintain at the raised position such that the vehicle does experience a bump arising from the raised speed bump.

Figure 1B:
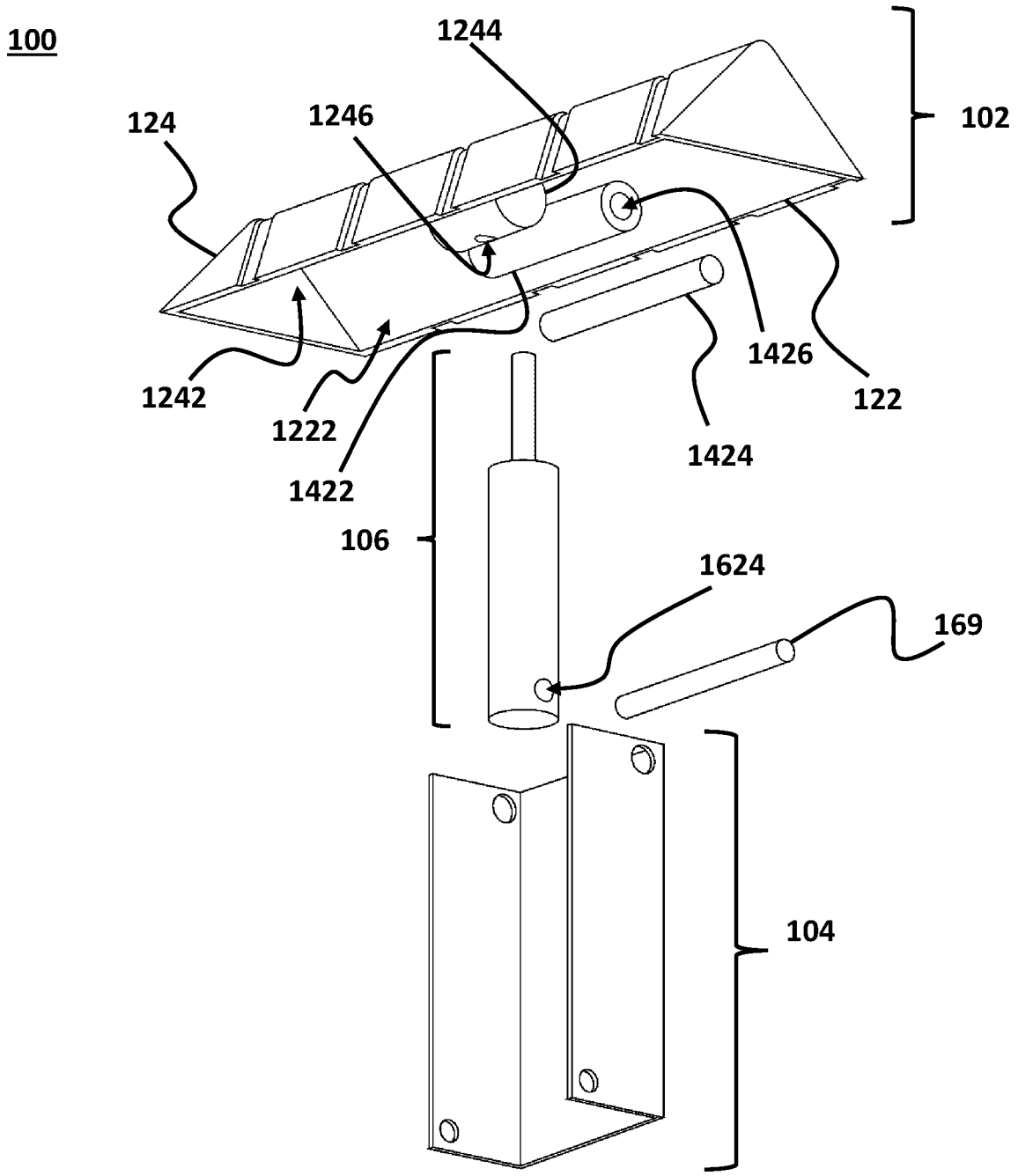
FIG. 1B illustrates an exploded view of a retractable speed bump, consistent with one or more exemplary embodiments of the present disclosure.

FIG. 1A shows a perspective view of a retractable speed bump 100, consistent with one or more exemplary embodiments of the present disclosure. FIG. 1B shows an exploded view of retractable speed bump 100, consistent with one or more exemplary embodiments of the present disclosure. As shown in FIG. 1A and FIG. 1B, in an exemplary embodiment, retractable speed bump 100 may include a retractile element 102, a chassis 104, and a hydraulic mechanism 106. In an exemplary embodiment, retractile element may be in a shape of a speed bump (a raised area along a driving surface) which may include, but may not be limited to, a triangular shape, a round/spherical raised surface, a raised flat surface with rounded edges, or combinations thereof. In an exemplary embodiment, retractile element 102 may include a first plate 122 having a rectangular shape and a second angled plate 124 having a rectangular shape. In an exemplary embodiment, first plate 122 may include a first edge and a first inner surface 1222.

In an exemplary embodiment, second angled plate 124 may include a second edge and a second inner surface 1224. In an exemplary embodiment, second angled plate 124 may be attached fixedly at the second edge of second angled plate 124 to the first edge of first plate 122 with a wedge angle 126 between first plate 122 and second angled plate 124. In an exemplary embodiment, first inner surface 1222 of first plate 122 may face second inner surface 1242 of second angled plate 124.

In an exemplary embodiment, retractile element 102 may be mounted hingedly on chassis 104 through a first pin mechanism 142. In an exemplary embodiment, first pin mechanism 142 may include a hollow cylindrical element 1422 and a first pin 1424. In an exemplary embodiment, hollow cylindrical element 1422 may include a longitudinal through hole 1426 along a main longitudinal axis of hollow cylindrical element 1422. In an exemplary embodiment, hollow cylindrical element 1422 may be attached fixedly to first inner surface 1222 of first plate 122. In an exemplary embodiment, fixedly attaching hollow cylindrical element 1422 to first inner surface 1222 of first plate 122 may prevent or otherwise minimize hollow cylindrical element 1422 movements relative to first plate 122.

In an exemplary embodiment, first pin 1424 may be disposed slidably and rotatably inside longitudinal through hole 1426. In an exemplary embodiment, first pin 1424 may also be attached fixedly to chassis 104 in a configuration such that prevents or otherwise minimize first pin 1424 movements relative to chassis 104.

Figure 2A:
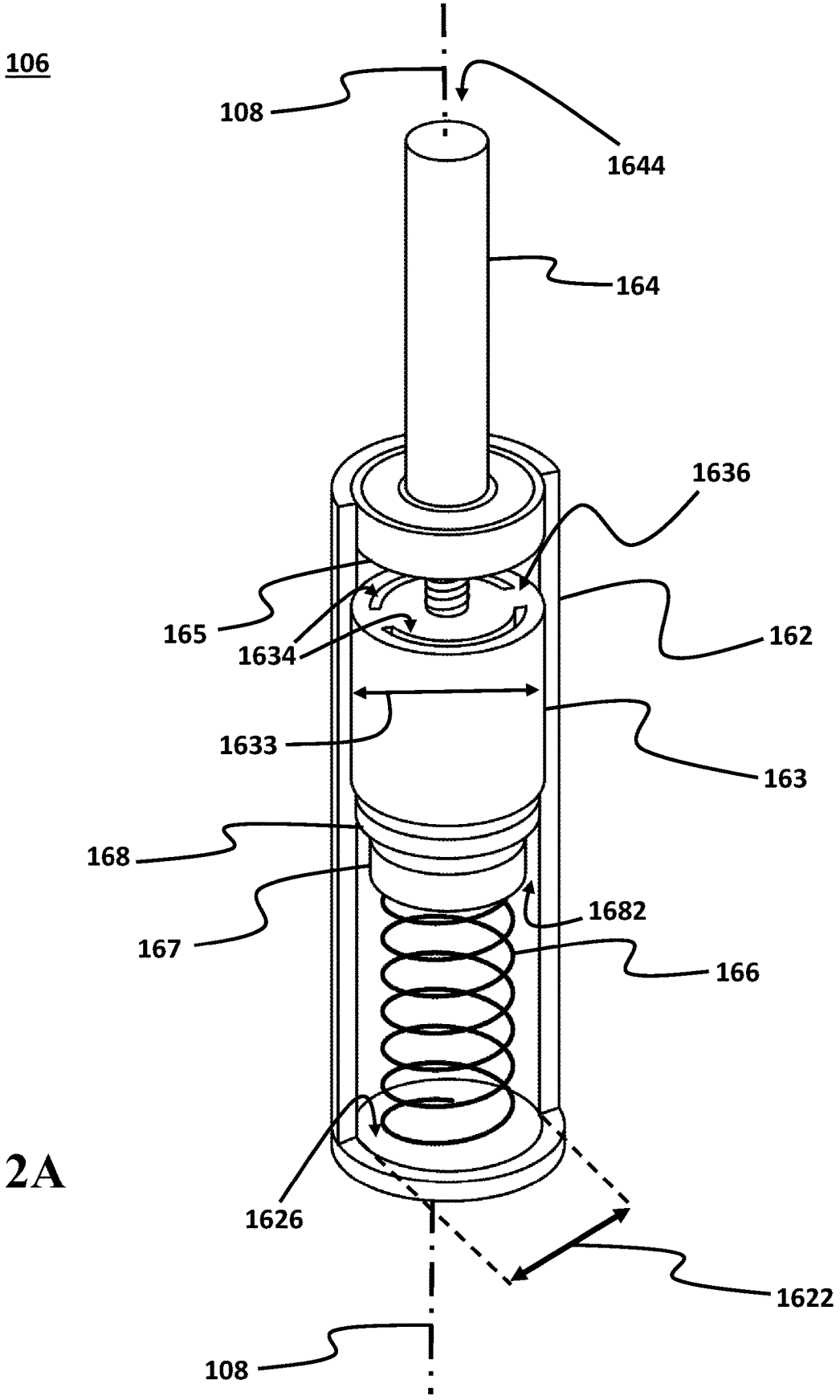
FIG. 2A illustrates a perspective view of a first hydraulic mechanism, consistent with one or more exemplary embodiments of the present disclosure.
Figure 2B:
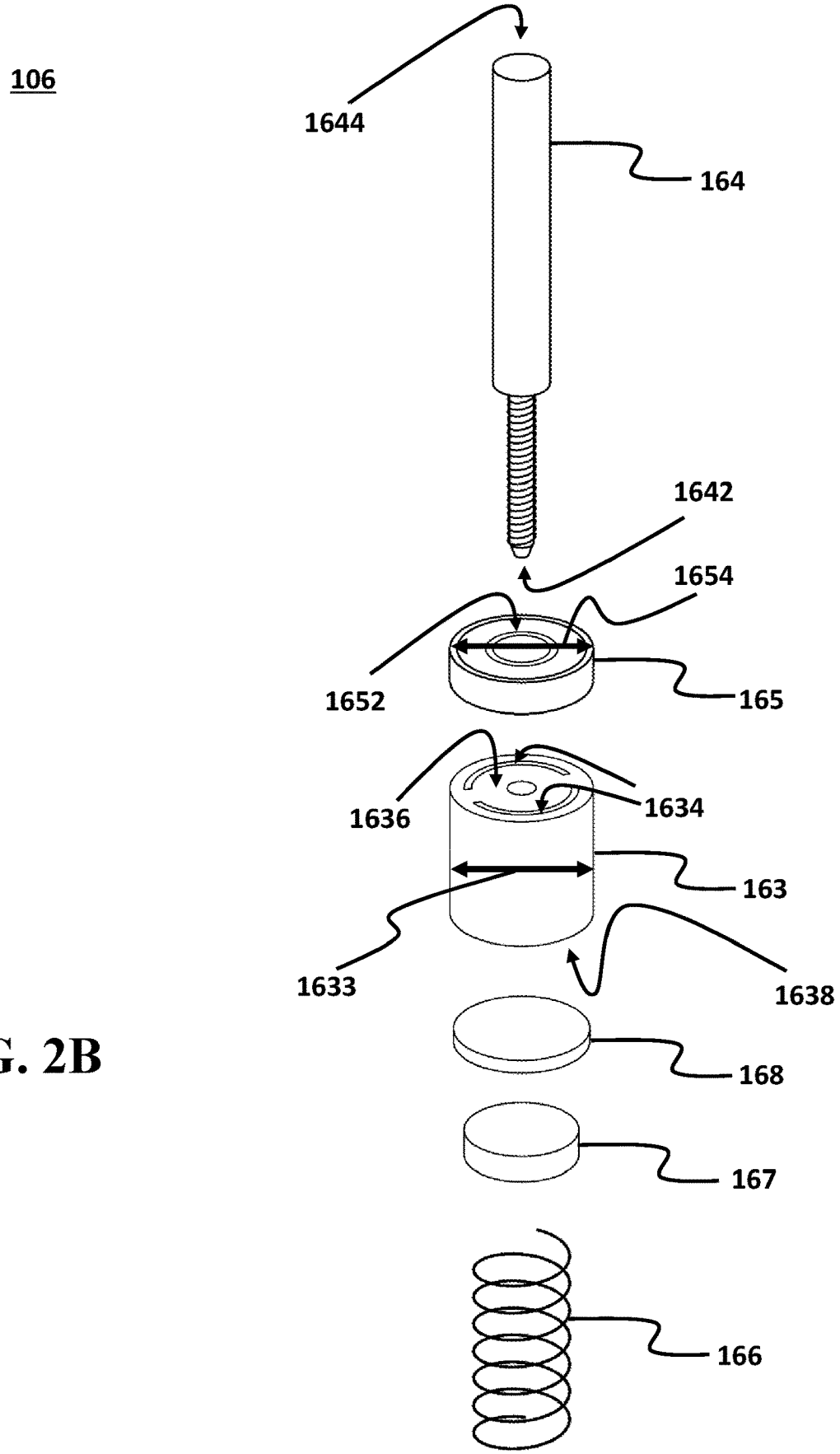
FIG. 2B illustrates an exploded view of a first hydraulic mechanism, consistent with one or more exemplary embodiments of the present disclosure.
Figure 2C:
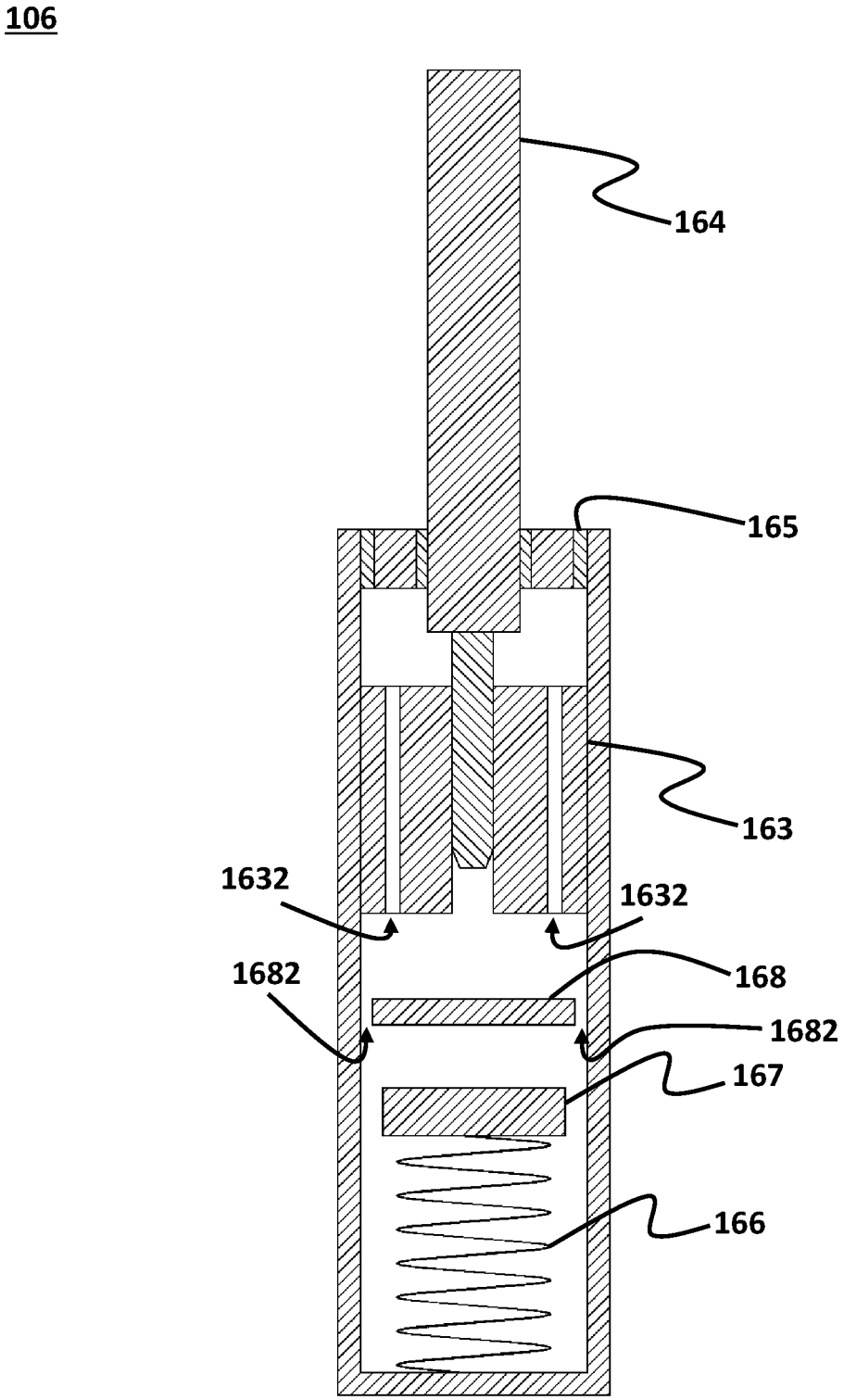
FIG. 2C illustrates a section-view of a first hydraulic mechanism, consistent with one or more exemplary embodiments of the present disclosure.

FIG. 2A shows a perspective view of hydraulic mechanism 106, consistent with one or more exemplary embodiments of the present disclosure. FIG. 2B shows an exploded view of hydraulic mechanism 106, consistent with one or more exemplary embodiments of the present disclosure. As shown in FIG. 2A and FIG. 2B, in an exemplary embodiment, hydraulic mechanism 106 may include a hydraulic cylinder 162, a hydraulic piston 163, a first connecting rod 164, an oil sealing member 165, a return spring 166, a spring retainer 167, and a floating gasket 168. In an exemplary embodiment, hydraulic cylinder 162 may have a hollow cylindrical shape. In an exemplary embodiment, hydraulic cylinder 162 may be filled with a hydraulic oil. In an exemplary embodiment, hydraulic cylinder 162 may include an inner diameter 1622. In an exemplary embodiment, hydraulic cylinder 162 may include a second pin insertion hole 1624 provided along a diameter of hydraulic cylinder 162. In an exemplary embodiment, hydraulic mechanism 106 may be mounted hingedly onto chassis 104 through a second pin 169. In an exemplary embodiment, second pin 169 may be attached fixedly to the chassis. In an exemplary embodiment, second pin 169 may be disposed slidably and rotatably inside second pin insertion hole 1624 of hydraulic cylinder 162. For purpose of reference it may be understood that mounting hydraulic mechanism 106 onto chassis 104 through second pin insertion hole 1624 and second pin 169 may provide a facility for hydraulic mechanism 106 which may allow hydraulic mechanism 106 experience a rotational movement around a main longitudinal axis of second pin insertion hole 1624.

In an exemplary embodiment, hydraulic piston 163 may have a solid cylindrical shape. In an exemplary embodiment, hydraulic piston 163 may include an outer diameter 1633. In an exemplary embodiment, hydraulic piston 163 may be disposed slidably inside hydraulic cylinder 162. In an exemplary embodiment, outer diameter 1633 of hydraulic piston 163 may correspond to inner diameter 1622 of hydraulic cylinder 162. For purpose of reference it may be understood that, in an exemplary embodiment, the correspondence of inner diameter 1622 of hydraulic cylinder 162 to outer diameter 1633 of hydraulic piston 163 may provide a sealing facility for hydraulic cylinder 162.

In an exemplary embodiment, hydraulic piston 163 may include a plurality of longitudinal through holes 1634 along a main longitudinal axis of the hydraulic piston. In an exemplary embodiment, plurality of longitudinal through holes 1634 may provide fluid communication between two up side 1636 of the hydraulic piston 163 and down side 1638 of hydraulic piston 163. For purpose of reference, it may be understood that, in an exemplary embodiment fluid communication between two up side 1636 of the hydraulic piston 163 and down side 1638 of hydraulic piston 163 may provide a facility for linear movement of hydraulic piston 163 along main axis 108 inside hydraulic cylinder 162.

In an exemplary embodiment, first connecting rod 164 may be attached fixedly at a bottom end 1642 thereof to an upper surface of hydraulic piston 163 and may also be connected hingedly at top end 1644 thereof to second inner surface 1242 of the second angled plate 124 through a hinge mechanism 1244. For purpose of reference, it may be understood that, in an exemplary embodiment, hinge mechanism 1244 may provide a facility for hydraulic mechanism 106 to be able to rotate around a main axis of hinge mechanism 1244.

In an exemplary embodiment, oil sealing member 165 may include a first connecting rod insertion hole 1652 and an outer diameter 1654. In an exemplary embodiment, oil sealing member 165 may be mounted fixedly from first connecting rod insertion hole 1652 thereof on first connecting rod 164 and disposed slidably inside hydraulic cylinder 162. In an exemplary embodiment, outer diameter 1654 of oil sealing member 165 may correspond to inner diameter 1622 of hydraulic cylinder 162. For purpose of reference, it may be understood that, in an exemplary embodiment, the correspondence between outer diameter 1654 of oil sealing member 165 and inner diameter 1622 of hydraulic cylinder 162 may provide a leakage facility for hydraulic cylinder 162.

In an exemplary embodiment, return spring 166 may be disposed on a bottom end 1626 of hydraulic cylinder 162. In an exemplary embodiment, spring retainer 167 may be mounted onto return spring 166. In an exemplary embodiment, return spring 166 may return spring retainer 167 to a first position of spring retainer 167 in a response to absence of a downward force exerted onto the spring retainer. In an exemplary embodiment, the first position of spring retainer 167 may be a position of spring retainer 167 when no forces are exerted to first connecting rod 164. For purpose of reference, it may be understood that return spring 166 and spring retainer 167 may provide a reset facility for hydraulic mechanism 106. In an exemplary embodiment, reset facility may refer to a mechanism that allow hydraulic mechanism 106 to return to hydraulic mechanism 106 initial configuration after a vehicle passed completely over the speed bump, that is, return to an initial configuration before any force may have been exerted by an exemplary vehicle on hydraulic mechanism 106.

In an exemplary embodiment, floating gasket 168 may be disposed slidably inside hydraulic cylinder 162 between hydraulic piston 163 and spring retainer 167. In an exemplary embodiment, a fluid gap 1682 may be defined between floating gasket 168 and an inner surface of hydraulic cylinder 162.

In an exemplary embodiment, hydraulic mechanism 106 may be mounted hingedly onto chassis 104 through second pin 169 attached fixedly to chassis 104. In an exemplary embodiment, second pin 169 may be disposed slidably and rotatably inside second pin insertion hole 164 of hydraulic cylinder 162.

Figure 2D:
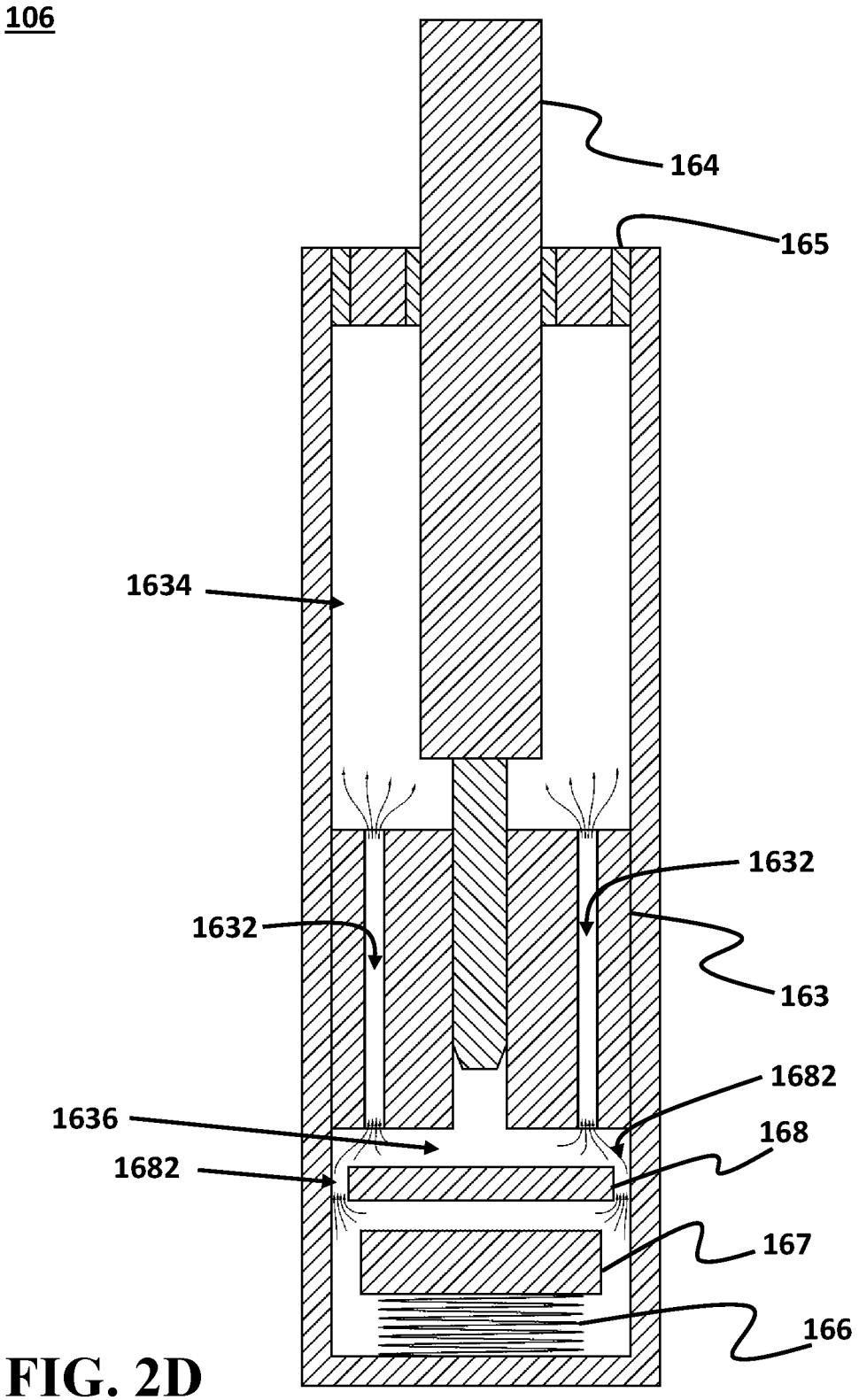
FIG. 2D illustrates a section-view of a first hydraulic mechanism when a vehicle passing over the speed bump slower than a threshold speed, consistent with one or more exemplary embodiments of the present disclosure.

In an exemplary embodiment, first connecting rod 164 may be connected to second inner surface 1242 of second angled plate 124 through hinge mechanism 1244. In an exemplary embodiment, hinge mechanism 1244 may be the same as a second connecting rod attached from a peripheral circular surface thereof to second inner surface 1242 of second angled plate 124. In an exemplary embodiment, second connecting rod may include a first connecting rod blind insertion hole 1246 provided along a diameter of second connecting rod. In an exemplary embodiment, first connecting rod 164 may be inserted into first connecting rod blind insertion hole 1246 of second connecting rod. FIG. 2D illustrates a section-view of a first hydraulic mechanism when a vehicle passes over the speed bump slower than a threshold speed, consistent with one or more exemplary embodiments of the present disclosure. In an exemplary embodiment, responsive to a vehicle passing over speed bump 100 slower than a first threshold speed, first connecting rod 164 may move downward at a speed lower than the second threshold speed. As shown in FIG. 2D, responsive to downward movement of first connecting rod 164 at a speed lower than the second threshold speed, floating gasket 168 may maintain float between spring retainer 167 and hydraulic cylinder 163. It may be understood that, floating gasket 168 may maintain float due to the fact that slow downward movement of hydraulic piston 163 may allow the hydraulic oil to go from a lower portion of floating gasket 168 to an upper portion of floating gasket 168 through fluid gap 1682. In an exemplary embodiment, floating floating gasket 168 may maintain fluid communication between up side 1634 (upper portion) of hydraulic piston 163 and down side 1636 (lower portion) of hydraulic piston 163 through plurality of longitudinal through holes 1632 and fluid gap 1682. In an exemplary embodiment, fluid communication between up side 1634 of hydraulic piston 163 and down side 1636 of hydraulic piston 163 may allow downward movement of first connecting rod 164 along main axis 108.

Figure 2E:
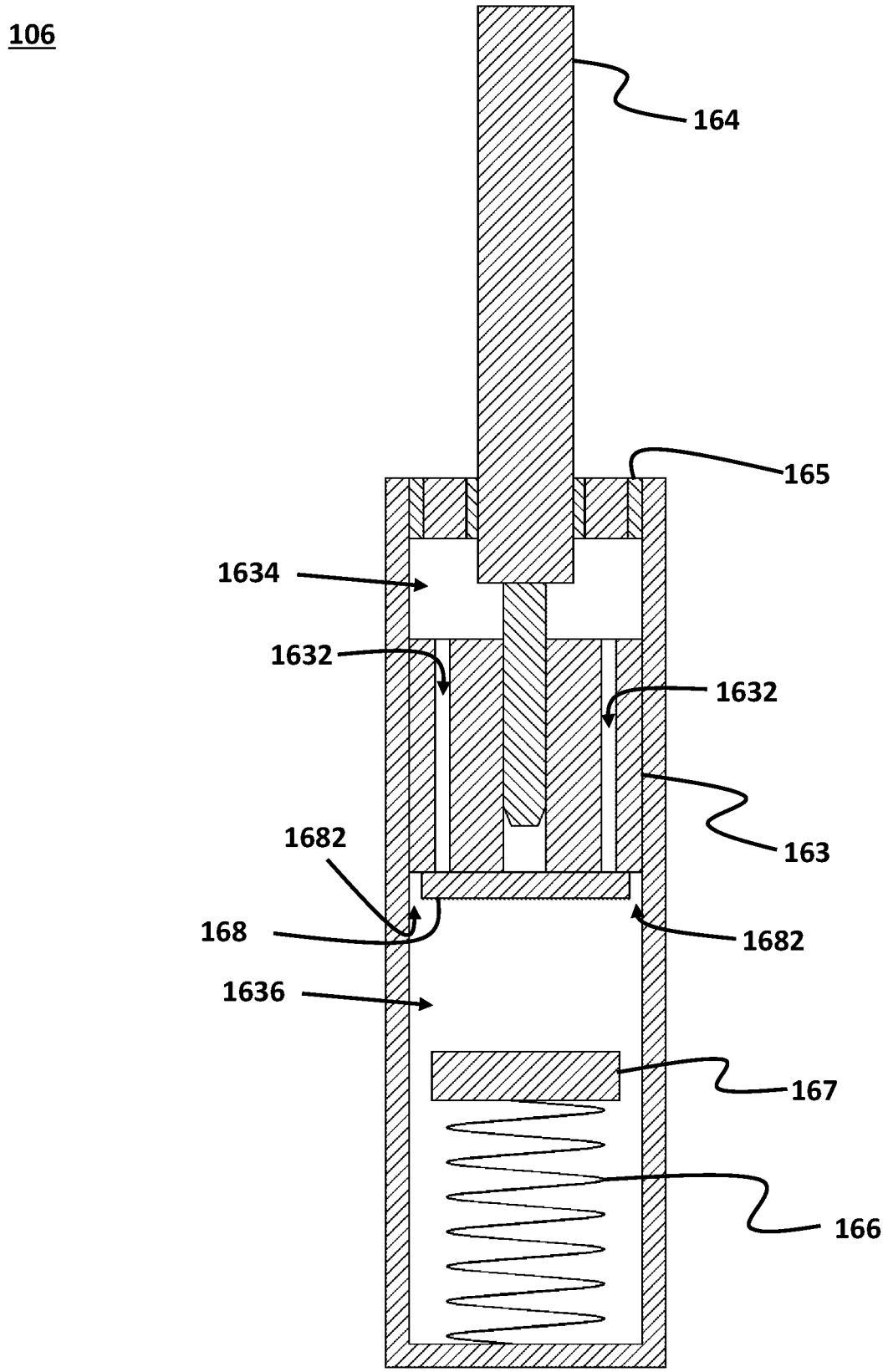
FIG. 2E illustrates a section-view of a first hydraulic mechanism when a vehicle passing over the speed bump faster than a threshold speed, consistent with one or more exemplary embodiments of the present disclosure.

FIG. 2E shows a section-view of a first hydraulic mechanism when a vehicle passes over the speed bump faster than a threshold speed, consistent with one or more exemplary embodiments of the present disclosure.

In an exemplary embodiment, responsive to a vehicle passing over speed bump 100 slower than a first threshold speed, first connecting rod 164 may move downward at a speed lower than a second threshold speed. As shown in FIG. 2D, responsive to downward movement of first connecting rod 164 at a speed lower than the second threshold speed, floating gasket 168 may maintain float between spring retainer 167 and hydraulic cylinder 163. It may be understood that, floating gasket 168 may maintain float according to the fact that slow downward movement of hydraulic piston 163 may allow the hydraulic oil to go from the down side of floating gasket 168 to up side of floating gasket 168 through fluid gap 1682. In an exemplary embodiment, floating floating gasket 168 may maintain fluid communication between up side 1636 of hydraulic piston 163 and down side 1638 of hydraulic piston 163 through plurality of longitudinal through holes 1634 and fluid gap 1682. In an exemplary embodiment, fluid communication between up side 1636 of hydraulic piston 163 and down side 1638 of hydraulic piston 163 may allow downward movement of first connecting rod 164 along main axis 108.

In an exemplary embodiment, the first threshold speed and the second threshold speed may be the same.

In an exemplary embodiment, the first threshold speed and the second threshold speed may be correlated. In an exemplary embodiment, the second threshold speed may be a function of the first threshold speed based on shape of retractile element 102, length of first connecting rod 164, or any other parameters.

In an exemplary embodiment, the first threshold speed and the second threshold speed may be adjusted through adjusting some features of hydraulic mechanism 106. For example, the second threshold speed may be a function of hydraulic cylinder 162 length, hydraulic cylinder 162 inner diameter 1622, floating gasket 168 diameter, the fluid gap 1682 between fluid gasket 168 and hydraulic cylinder 162. For example, in an exemplary embodiment, a user may adjust the threshold speed by changing the fluid gap 1682 between fluid gasket 168 and hydraulic cylinder 162.

In an exemplary embodiment, responsive to absence of an external force exerting onto first connecting rod 164, return spring 166 may push hydraulic cylinder 163 and first connecting rod 164 to move upward along main axis 108 until reach respectively a first position of hydraulic cylinder 163 and a first position of first connecting rod 164. In an exemplary embodiment, responsive to absence of the external force exerting onto first connecting rod 164, upward force of return spring 166 onto spring retainer 167 may overcome downward force of hydraulic oil pressure onto spring retainer 167 and consequently, spring retainer 167 may move upward and urge hydraulic cylinder 163 and first connecting rod 164 move upward.

In an exemplary embodiment, return spring 166 and spring retainer 167 may provide a reset facility for hydraulic mechanism 106. In an exemplary embodiment, reset facility may refer to a mechanism that may allow hydraulic mechanism 106 to return to hydraulic mechanism 106 initial configuration after a vehicle passed completely over the speed bump. In an exemplary embodiment, the first position of first connecting rod 164 may be the same as the position of first connecting rod 164 when no external force is exerted onto first connecting rod 164. And similarly, the first position of hydraulic cylinder 163 may be the same as the position of hydraulic cylinder 163 when no external force is exerted onto first connecting rod 164.

Figure 3A:
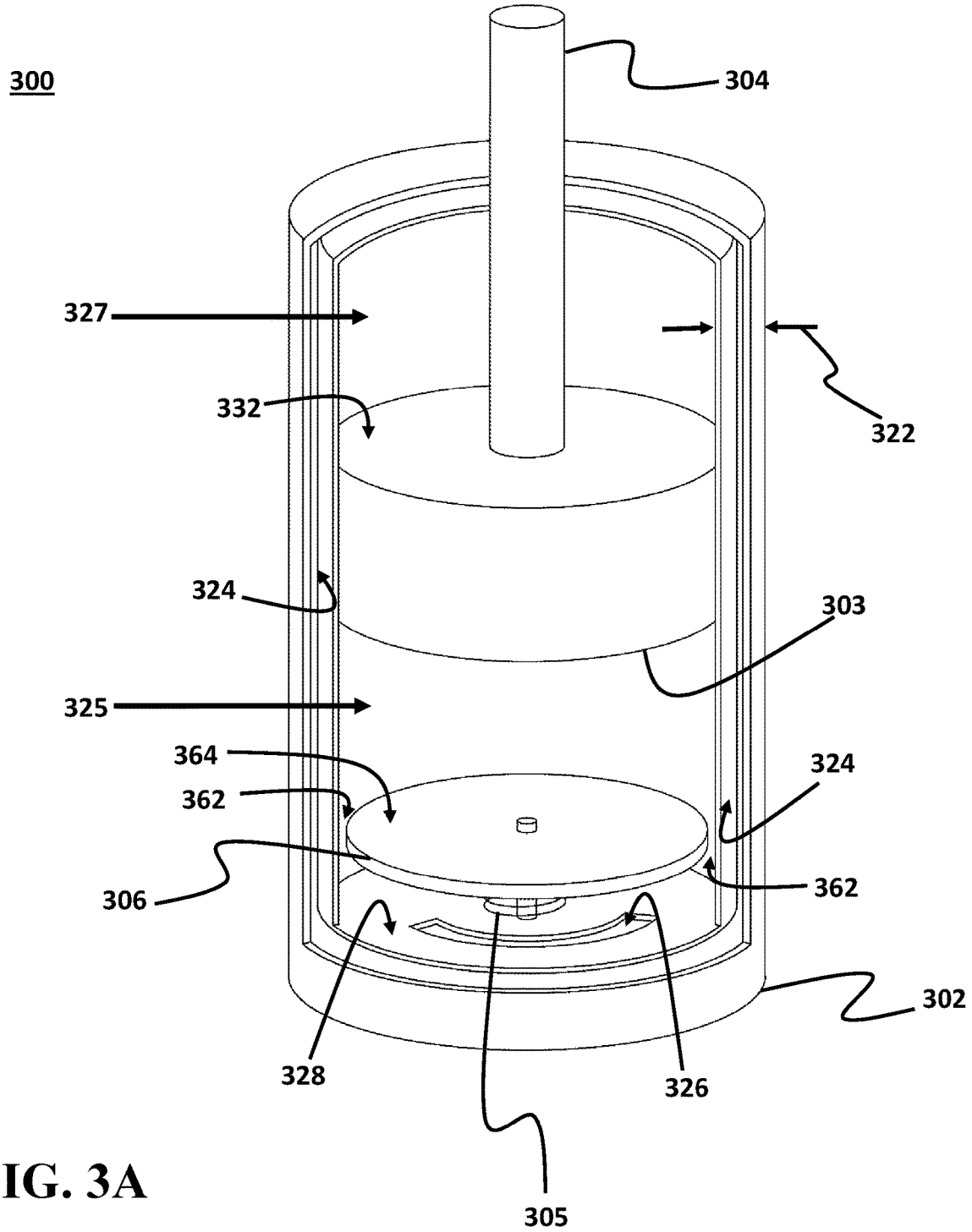
FIG. 3A illustrates a perspective view of a second hydraulic mechanism, consistent with one or more exemplary embodiments of the present disclosure.
Figure 3B:
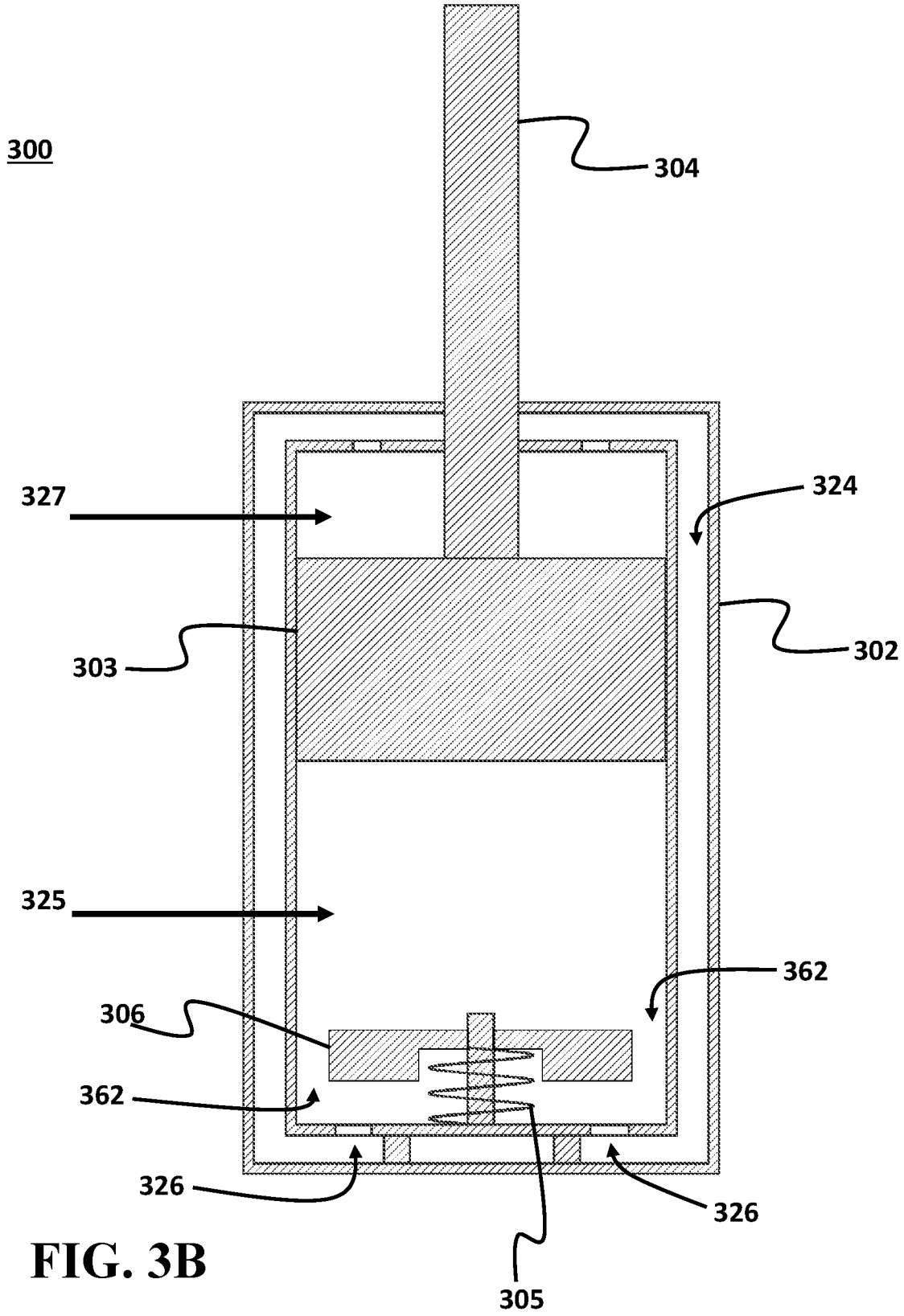
FIG. 3B illustrates a section-view of a second hydraulic mechanism, consistent with one or more exemplary embodiments of the present disclosure.

FIG. 3A shows a perspective view of a second hydraulic mechanism 300, consistent with one or more exemplary embodiments of the present disclosure. In an exemplary embodiment, second hydraulic mechanism 300 may be utilized as hydraulic mechanism in retractable speed bump 100. As shown in FIG. 3, in an exemplary embodiment, alternative hydraulic mechanism 300 may include a hydraulic cylinder 302, a hydraulic piston 303, a first connecting rod 304, a return spring 305, and a gasket 306.

In an exemplary embodiment, hydraulic cylinder 302 may include a hollow wall 322 defining a shell oil reservoir 324. In an exemplary embodiment, hydraulic cylinder 302 may be in fluid communication with shell oil reservoir 324 through a plurality of holes 326. In an exemplary embodiment, hydraulic cylinder 302 may include a second pin insertion hole 1624 provided along a diameter of hydraulic cylinder 302.

In an exemplary embodiment, hydraulic piston 303 may be disposed slidably within hydraulic cylinder 302. In an exemplary embodiment, first connecting rod 304 may be attached fixedly to an upper surface 332 of hydraulic piston 303. In an exemplary embodiment, return spring 305 may be disposed on a bottom surface 328 of the hydraulic cylinder 302. In an exemplary embodiment, gasket 306 may be mounted onto return spring 305. In an exemplary embodiment, gasket gap 362 may refer to distance between gasket 306 and interior surface of hydraulic piston 302.

In an exemplary embodiment, an outer diameter of hydraulic piston 303 may correspond to an inner diameter of hydraulic cylinder 302. For purpose of reference, it may be understood that the correspondence of outer diameter of hydraulic piston 303 and inner diameter of hydraulic cylinder 302 may provide a facility for fluid communication through a space between hydraulic piston 303 and hydraulic cylinder 302.

Figure 3C:
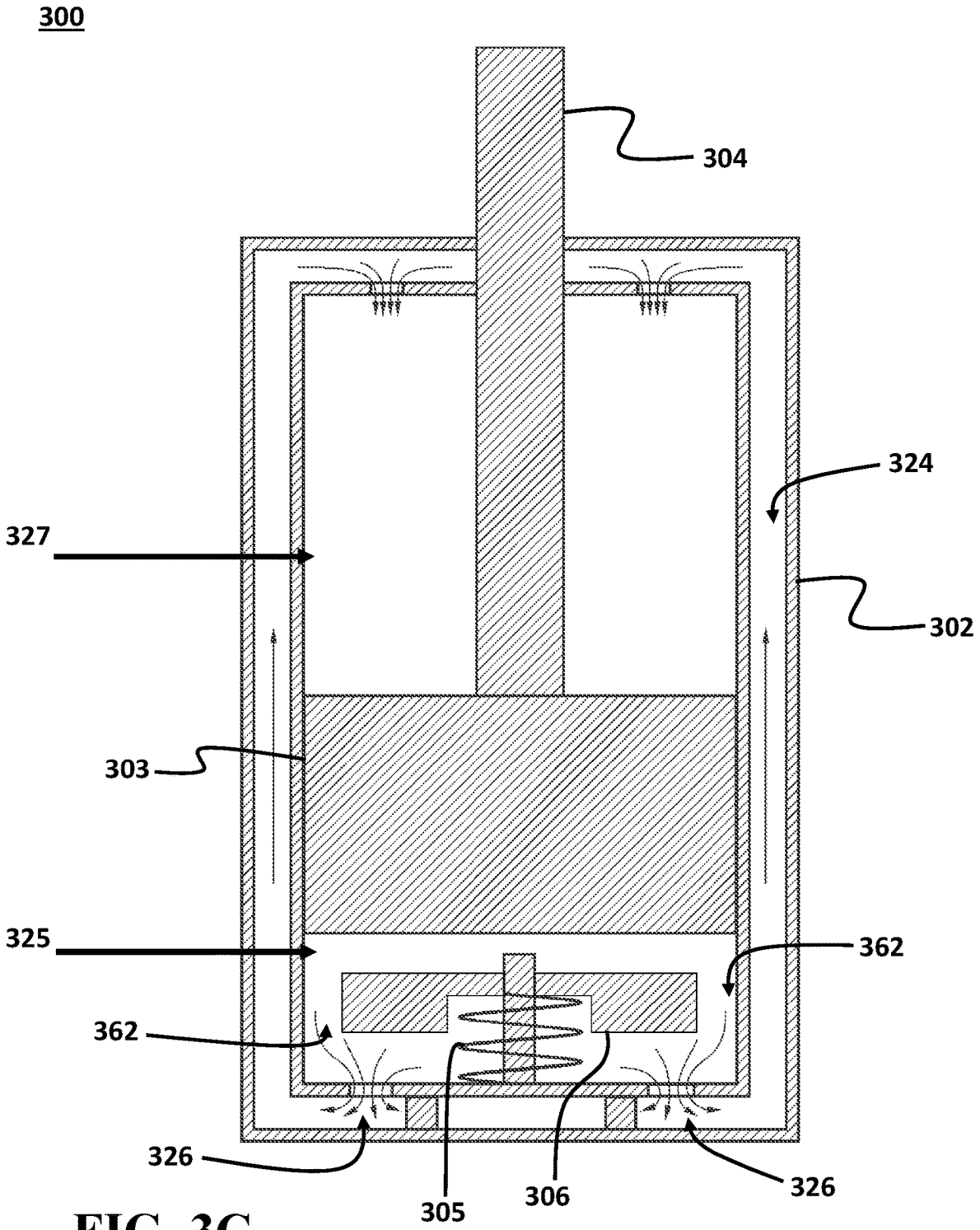
FIG. 3C illustrates a section-view of a second hydraulic mechanism when a vehicle passing over the speed bump slower than a threshold speed, consistent with one or more exemplary embodiments of the present disclosure.

FIG. 3C shows a section-view of a second hydraulic mechanism when a vehicle passes over the speed bump slower than a threshold speed, consistent with one or more exemplary embodiments of the present disclosure.

In an exemplary embodiment, responsive to a vehicle passing over speed bump 100 slower than a first threshold speed, first connecting rod 304 and hydraulic piston 303 may move downward at a speed lower than the second threshold speed. As shown in FIG. 3C, in an exemplary embodiment, responsive to downward movement of hydraulic piston 303 at a speed below the threshold speed, gasket 306 may remain stationary. In an exemplary embodiment, it may be understood that gasket 306 may remain stationary due to the fact that slow downward movement of hydraulic piston 303 may allow hydraulic oil go from up side of gasket 306 to down side of gasket 306 through gasket gap 362. In an exemplary embodiment, going hydraulic oil from up side of gasket 306 to down side of gasket 306 through gasket gap 362 may provide hydraulic oil communication between lower section 325 of hydraulic cylinder 302 and upper section 327 of hydraulic cylinder 302 through plurality of longitudinal through holes 326 and shell oil reservoir 324. In an exemplary embodiment, providing hydraulic oil communication between lower section 325 of hydraulic cylinder 302 and upper section 327 of hydraulic cylinder 302 through plurality of longitudinal through holes 326 and shell oil reservoir 324 may allow downward movement of first connecting rod 304 and hydraulic piston 303.

Figure 3D:
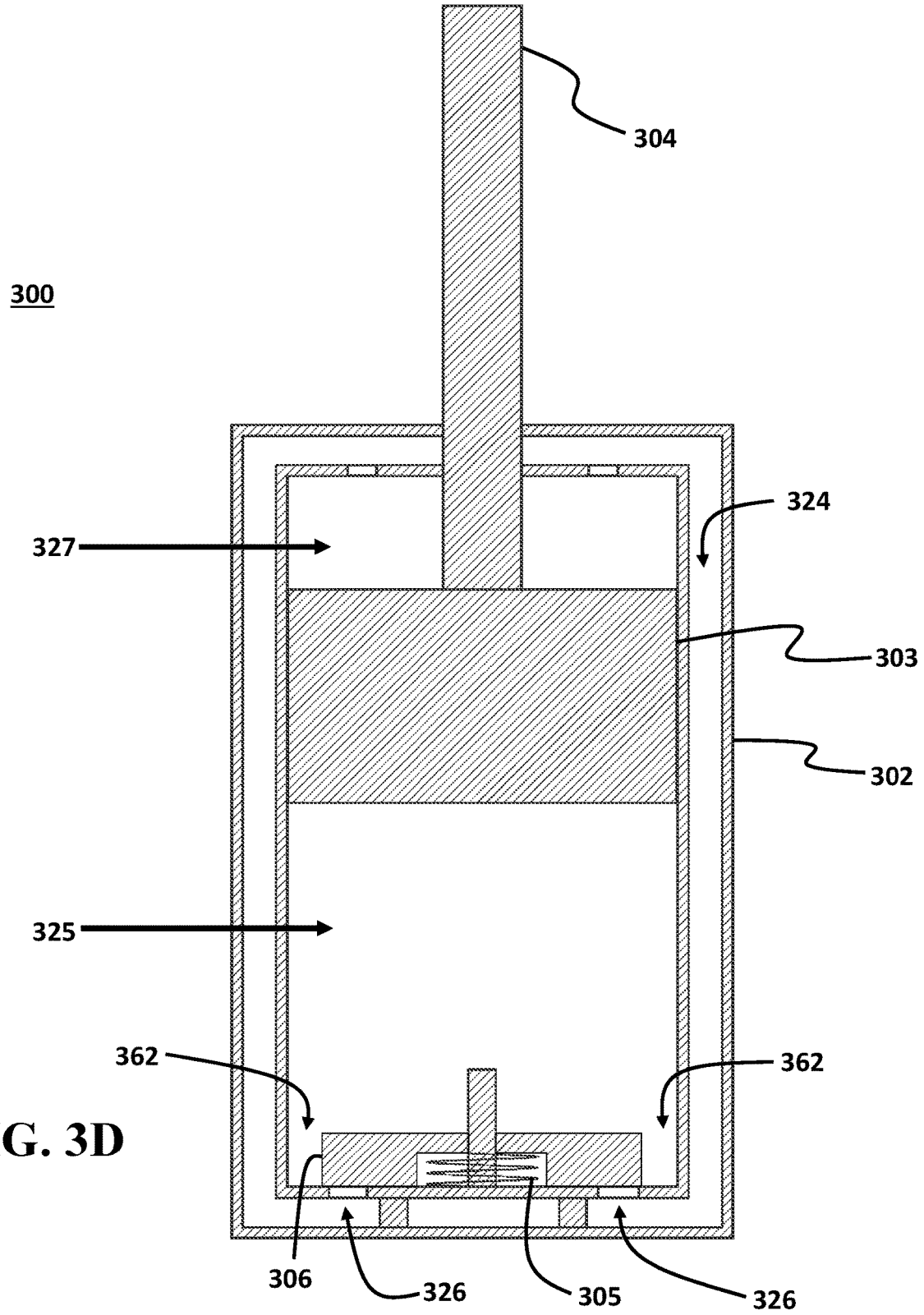
FIG. 3D illustrates a section-view of a second hydraulic mechanism when a vehicle passing over the speed bump faster than a threshold speed, consistent with one or more exemplary embodiments of the present disclosure.

FIG. 3D shows a section-view of a second hydraulic mechanism when a vehicle passing over the speed bump faster than a threshold speed, consistent with one or more exemplary embodiments of the present disclosure.

In an exemplary embodiment, responsive to a vehicle passing over speed bump 100 faster than the first threshold speed, first connecting rod 304 may move downward at a speed higher than the second threshold speed. In an exemplary embodiment, responsive to downward movement of first connecting rod 304 at a speed higher than a threshold speed, gasket 306 may move downward and may stick to bottom surface 328 of hydraulic cylinder 302. In an exemplary embodiment, it may be understood that, gasket 306 may move downward and stick to bottom surface 328 of hydraulic cylinder 302 due to the fact that fast downward movement of hydraulic piston 303 may not allow sufficient hydraulic oil communication between an upper portion of gasket 306 and lower portion of gasket 306 through gasket gap 362 and, consequently, higher hydraulic oil pressure at an upper portion of gasket 306 relative to lower hydraulic oil pressure at down side of gasket 306 may urge gasket 306 move downward and stick to top surface 364 of hydraulic cylinder 302. In an exemplary embodiment, sticking gasket 306 to bottom surface 328 of hydraulic cylinder 302 may block plurality of holes 326 of hydraulic cylinder 302. In an exemplary embodiment, plurality of through holes 326 blockage may prevent fluid communication between lower section 325 of hydraulic cylinder 302 and upper section 327 of hydraulic cylinder 302 through plurality of holes 326 and shell oil reservoir 324. In an exemplary embodiment, fluid communication between lower section 325 of hydraulic cylinder 302 and upper section 327 of hydraulic cylinder 302 through plurality of holes 326 and shell oil reservoir 324 may prevent downward movement of first connecting rod 304.

In an exemplary embodiment, responsive to absence of an external force exerting onto first connecting rod 304, return spring 305 may push hydraulic cylinder 303 and first connecting rod 304 to move upward until reach respectively a first position of hydraulic cylinder 303 and a first position of first connecting rod 304. In an exemplary embodiment, responsive to absence of the external force exerting onto first connecting rod 304, upward force of return spring 305 onto gasket 306 may overcome downward force of hydraulic oil pressure onto gasket 306 and consequently, gasket 306 may move upward and urge hydraulic cylinder 303 and first connecting rod 304 move upward. It may be understood that the first position of first connecting rod 304 may be the same as the position of first connecting rod 304 when no external force is exerted onto first connecting rod 304. And similarly, the first position of hydraulic cylinder 303 may be the same as the position of hydraulic cylinder 303 when no external force is exerted onto first connecting rod 304. In an exemplary embodiment, return spring 305 may provide a reset facility for second hydraulic mechanism. In an exemplary embodiment, reset facility may refer to a mechanism that allow second hydraulic mechanism to return to second hydraulic mechanism initial configuration after a vehicle passed completely over the speed bump.

Figure 4A:
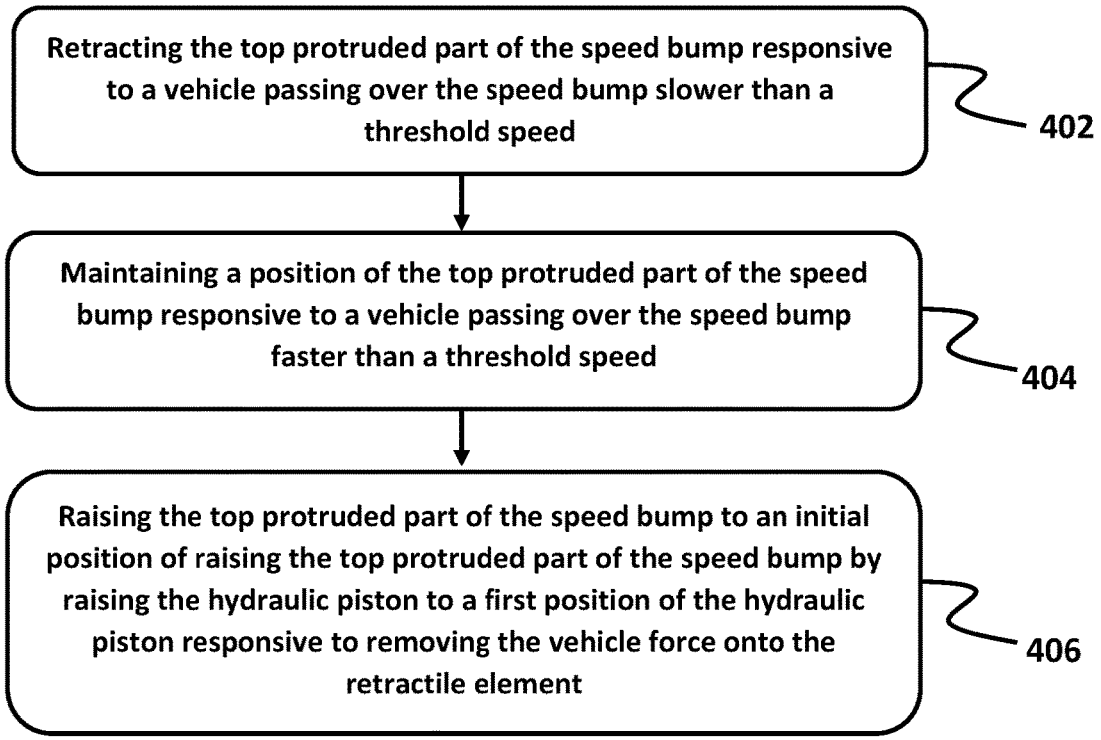
FIG. 4A illustrates a method for retracting a speed bump, consistent with one or more exemplary embodiments of the present disclosure.

FIG. 4A shows a method for retracting a speed bump, consistent with one or more exemplary embodiments of the present disclosure. Referring now to FIG. 4A, a method 400 for retracting a speed bump is illustrated, consistent with one or more exemplary embodiments of the present disclosure. In an exemplary embodiment, method 400 may include step 402 of retracting the top protruded part of the speed bump responsive to a vehicle passing over the speed bump slower than a threshold speed. In an exemplary embodiment, the top protruded part of the speed bump may be connected to a hydraulic mechanism by a connecting rod. In an exemplary embodiment, method 400 may further include step 404 of maintaining a position of the top protruded part of the speed bump responsive to a vehicle passing over the speed bump faster than a threshold speed. In an exemplary embodiment, method 400 may further include step 406 of raising the top protruded part of the speed bump to an initial position of raising the top protruded part of the speed bump by raising the hydraulic piston to a first position of the hydraulic piston responsive to removing the vehicle force exerted onto the retractile element.

Figure 4B:
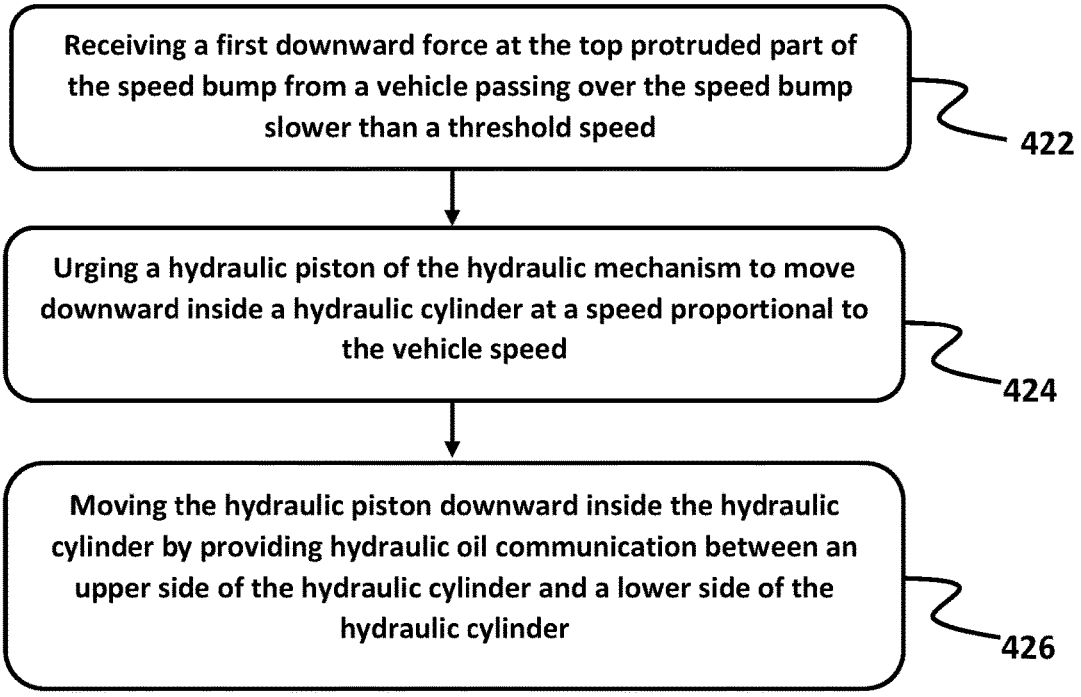
FIG. 4B illustrates a method for retracting the top protruded part of the speed bump responsive to a vehicle passing over the speed bump slower than a threshold speed, consistent with one or more exemplary embodiments of the present disclosure.

FIG. 4B illustrates a method for retracting the top protruded part of the speed bump responsive to a vehicle passing over the speed bump slower than a threshold speed, consistent with one or more exemplary embodiments of the present disclosure. As shown in FIG. 4B, in an exemplary embodiment, retracting the top protruded part of the speed bump responsive to the vehicle passing over the speed bump slower than the threshold speed may include step 422 of receiving a first downward force at the top protruded part of the speed bump from a vehicle passing over the speed bump slower than a threshold speed. In an exemplary embodiment, retracting the top protruded part of the speed bump responsive to the vehicle passing over the speed bump slower than the threshold speed may further include step 424 of urging a hydraulic piston of the hydraulic mechanism to move downward inside a hydraulic cylinder at a speed proportional to the vehicle speed utilizing the connecting rod transferring the first downward force to the hydraulic piston, and step 426 of moving the hydraulic piston downward inside the hydraulic cylinder by providing hydraulic oil communication between an upper side of the hydraulic cylinder and a lower side of the hydraulic cylinder.

Figure 4C:
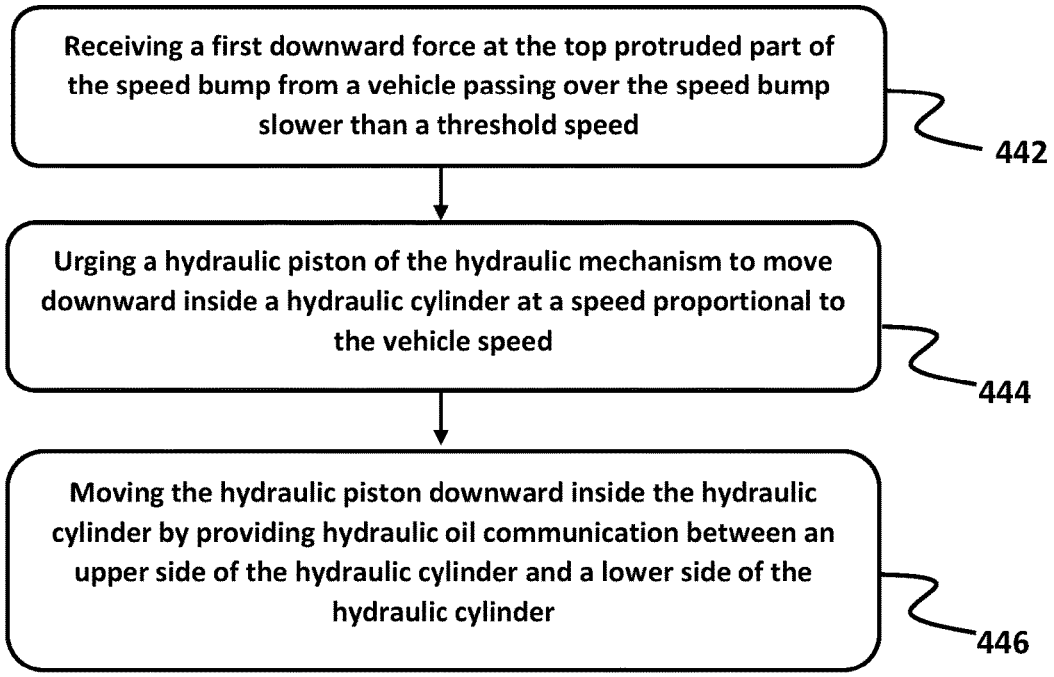
FIG. 4C illustrates a method for maintaining a position of the top protruded part of the speed bump responsive to a vehicle passing over the speed bump faster than a threshold speed, consistent with one or more exemplary embodiments of the present disclosure.

FIG. 4C illustrates a method for maintaining a position of the top protruded part of the speed bump responsive to a vehicle passing over the speed bump faster than a first threshold speed, consistent with one or more exemplary embodiments of the present disclosure.

As shown in FIG. 4C, in an exemplary embodiment, maintaining a position of the top protruded part of the speed bump responsive to a vehicle passing over the speed bump faster than a threshold speed may include step 442 of receiving a second downward force at the top protruded part of the speed bump from the vehicle passing over the speed bump faster than the threshold speed, step 444 of urging the hydraulic piston of the hydraulic mechanism move downward inside a hydraulic cylinder at a speed proportional to the vehicle speed utilizing the connecting rod transferring the second downward force to the hydraulic piston, and step 446 of preventing the hydraulic piston downward movement inside the hydraulic cylinder by blocking hydraulic oil communication between the upper side of the hydraulic cylinder and the lower side of the hydraulic cylinder.

In an exemplary embodiment, method 400 may utilize an exemplary speed bump that may be substantially analogous to speed bump 100 shown in FIG. 1A. FIG. 1A shows a perspective view of a retractable speed bump 100, consistent with one or more exemplary embodiments of the present disclosure. FIG. 1B shows an exploded view of retractable speed bump 100, consistent with one or more exemplary embodiments of the present disclosure. As shown in FIG. 1A and FIG. 1B, in an exemplary embodiment, retractable speed bump 100 may include a retractile element 102, a chassis 104, and a hydraulic mechanism 106. In an exemplary embodiment, retractile element may be in a shape of a speed bump (a raised area along a driving surface) which may include, but may not be limited to, a triangular shape, a round/spherical raises surface, a raised flat surface with rounded edges, or combinations thereof. In an exemplary embodiment, retractile element 102 may include a first plate 122 having a rectangular shape and a second angled plate 124 having a rectangular shape. In an exemplary embodiment, first plate 122 may include a first edge and a first inner surface 1222.

In an exemplary embodiment, second angled plate 124 may include a second edge and a second inner surface 1224. In an exemplary embodiment, second angled plate 124 may be attached fixedly at the second edge of second angled plate 124 to the first edge of first plate 122 with a wedge angle 126 between first plate 122 and second angled plate 124. In an exemplary embodiment, first inner surface 1222 of first plate 122 may be faced second inner surface 1242 of second angled plate 124.

In an exemplary embodiment, retractile element 102 may be mounted hingedly on chassis 104 through a first pin mechanism 142. In an exemplary embodiment, first pin mechanism 142 may include a hollow cylindrical element 1422 and a first pin 1424. In an exemplary embodiment, hollow cylindrical element 1422 may include a longitudinal through hole 1426 along a main longitudinal axis of hollow cylindrical element 1422. In an exemplary embodiment, hollow cylindrical element 1422 may be attached fixedly to first inner surface 1222 of first plate 122. In an exemplary embodiment, fixedly attaching hollow cylindrical element 1422 to first inner surface 1222 of first plate 122 may prevent or otherwise minimize hollow cylindrical element 1422 movements relative to first plate 122.

In an exemplary embodiment, first pin 1424 may be disposed slidably and rotatably inside longitudinal through hole 1426. In an exemplary embodiment, first pin 1424 may also be attached fixedly to chassis 104 in a configuration such that prevents or otherwise minimize first pin 1424 movements relative to chassis 104.

FIG. 2A shows a perspective view of hydraulic mechanism 106, consistent with one or more exemplary embodiments of the present disclosure. FIG. 2B shows an exploded view of hydraulic mechanism 106, consistent with one or more exemplary embodiments of the present disclosure. As shown in FIG. 2A and FIG. 2B, in an exemplary embodiment, hydraulic mechanism 106 may include a hydraulic cylinder 162, a hydraulic piston 163, a first connecting rod 164, an oil sealing member 165, a return spring 166, a spring retainer 167, and a floating gasket 168. In an exemplary embodiment, hydraulic cylinder 162 may have a hollow cylindrical shape. In an exemplary embodiment, hydraulic cylinder 162 may be filled with a hydraulic oil. In an exemplary embodiment, hydraulic cylinder 162 may include an inner diameter 1622. In an exemplary embodiment, hydraulic cylinder 162 may include a second pin insertion hole 1624 provided along a diameter of hydraulic cylinder 162. In an exemplary embodiment, hydraulic mechanism 106 may be mounted hingedly onto chassis 104 through a second pin 169. In an exemplary embodiment, second pin 169 may be attached fixedly to the chassis. In an exemplary embodiment, second pin 169 may be disposed slidably and rotatably inside second pin insertion hole 1624 of hydraulic cylinder 162. For purpose of reference it may be understood that mounting hydraulic mechanism 106 onto chassis 104 through second pin insertion hole 1624 and second pin 169 may provide a facility for hydraulic mechanism 106 which may allow hydraulic mechanism 106 experience a rotational movement around a main longitudinal axis of second pin insertion hole 1624.

In an exemplary embodiment, hydraulic piston 163 may have a solid cylindrical shape. In an exemplary embodiment, hydraulic piston 163 may include an outer diameter 1632. In an exemplary embodiment, hydraulic piston 163 may be disposed slidably inside hydraulic cylinder 162. In an exemplary embodiment, outer diameter 1633 of hydraulic piston 163 may correspond to inner diameter 1622 of hydraulic cylinder 162. For purpose of reference it may be understood that, in an exemplary embodiment, the correspondence of inner diameter 1622 of hydraulic cylinder 162 to outer diameter 1633 of hydraulic piston 163 may provide a sealing facility for hydraulic cylinder 162. In an exemplary embodiment, hydraulic piston 163 may include a plurality of longitudinal through holes 1634 along a main longitudinal axis of the hydraulic piston. In an exemplary embodiment, plurality of longitudinal through holes 1634 may provide fluid communication between two up side 1636 of the hydraulic piston 163 and down side 1638 of hydraulic piston 163. For purpose of reference, it may be understood that, in an exemplary embodiment fluid communication between two up side 1636 of the hydraulic piston 163 and down side 1638 of hydraulic piston 163 may provide a facility for linear movement of hydraulic piston 163 along main axis 108 inside hydraulic cylinder 162.

In an exemplary embodiment, first connecting rod 164 may be attached fixedly at a bottom end 1642 thereof to an upper surface of hydraulic piston 163 and may also be connected hingedly at top end 1644 thereof to second inner surface 1242 of the second angled plate 124 through a hinge mechanism 1244. For purpose of reference, it may be understood that, in an exemplary embodiment, hinge mechanism 1244 may provide a facility for hydraulic mechanism 106 to be able to rotate around a main axis of hinge mechanism 1244.

In an exemplary embodiment, oil sealing member 165 may include a first connecting rod insertion hole 1652 and an outer diameter 1654. In an exemplary embodiment, oil sealing member 165 may be mounted fixedly from first connecting rod insertion hole 1652 thereof on first connecting rod 164 and disposed slidably inside hydraulic cylinder 162. In an exemplary embodiment, outer diameter 1654 of oil sealing member 165 may correspond to inner diameter 1622 of hydraulic cylinder 162. For purpose of reference, it may be understood that, in an exemplary embodiment, the correspondence between outer diameter 1654 of oil sealing member 165 and inner diameter 1622 of hydraulic cylinder 162 may provide a leakage facility for hydraulic cylinder 162.

In an exemplary embodiment, return spring 166 may be disposed on a bottom end 1626 of hydraulic cylinder 162. In an exemplary embodiment, spring retainer 167 may be mounted onto return spring 166. In an exemplary embodiment, return spring 166 may return spring retainer 167 to a first position of spring retainer 167 in a response to absence of a downward force exerted onto the spring retainer. In an exemplary embodiment, the first position of spring retainer 167 may be a position of spring retainer 167 when no forces are exerted to first connecting rod 164. For purpose of reference, it may be understood that return spring 166 and spring retainer 167 may provide a reset facility for hydraulic mechanism 106. In an exemplary embodiment, reset facility may refer to a mechanism that allow hydraulic mechanism 106 to return to hydraulic mechanism 106 initial configuration when a vehicle passed completely over the speed bump.

In an exemplary embodiment, floating gasket 168 may be disposed slidably inside hydraulic cylinder 162 between hydraulic piston 163 and spring retainer 167. In an exemplary embodiment, a fluid gap 1682 may be defined between floating gasket 168 and an inner surface of hydraulic cylinder 162.

In an exemplary embodiment, hydraulic mechanism 106 may be mounted hingedly onto chassis 104 through second pin 169 attached fixedly to chassis 104. In an exemplary embodiment, second pin 169 may be disposed slidably and rotatably inside second pin insertion hole 164 of hydraulic cylinder 162.

In an exemplary embodiment, first connecting rod 164 may be connected to second inner surface 1242 of second angled plate 124 through hinge mechanism 1244. In an exemplary embodiment, hinge mechanism 1244 may be the same as a second connecting rod attached from a peripheral circular surface thereof to second inner surface 1242 of second angled plate 124. In an exemplary embodiment, second connecting rod may include a first connecting rod blind insertion hole 1246 provided along a diameter of second connecting rod. In an exemplary embodiment, first connecting rod 164 may be inserted into first connecting rod blind insertion hole 1246 of second connecting rod.

FIG. 2D illustrates a section-view of a first hydraulic mechanism when a vehicle passing over the speed bump slower than a threshold speed, consistent with one or more exemplary embodiments of the present disclosure.

In an exemplary embodiment, responsive to a vehicle passing over speed bump 100 slower than a first threshold speed, first connecting rod 164 may move downward at a speed lower than the second threshold speed. As shown in FIG. 2D, responsive to downward movement of first connecting rod 164 at a speed lower than the second threshold speed, floating gasket 168 may maintain float between spring retainer 167 and hydraulic cylinder 163. It may be understood that, floating gasket 168 may maintain float according to the fact that slow downward movement of hydraulic piston 163 may allow the hydraulic oil to go from the down side of floating gasket 168 to up side of floating gasket 168 through fluid gap 1682. In an exemplary embodiment, floating floating gasket 168 may maintain fluid communication between up side 1634 of hydraulic piston 163 and down side 1636 of hydraulic piston 163 through plurality of longitudinal through holes 1632 and fluid gap 1682. In an exemplary embodiment, fluid communication between up side 1634 of hydraulic piston 163 and down side 1636 of hydraulic piston 163 may allow downward movement of first connecting rod 164 along main axis 108.

FIG. 2E shows a section-view of a first hydraulic mechanism when a vehicle passing over the speed bump faster than a threshold speed, consistent with one or more exemplary embodiments of the present disclosure.

In an exemplary embodiment, responsive to a vehicle passing over speed bump 100 faster than the first threshold speed, first connecting rod 164 may move downward at a speed higher than the second threshold speed. As shown in FIG. 2E, in an exemplary embodiment, responsive to downward movement of first connecting rod 164 at a speed higher than the second threshold speed, floating gasket 168 may move upward along main axis 108 and may stick to a down side 1638 of hydraulic piston 163. In an exemplary embodiment, it may be understood that, floating gasket 168 may move upward and stick to down side 1638 of hydraulic piston 163 according to the fact that fast downward movement of hydraulic piston 163 may not allow sufficient hydraulic oil communication between up side of floating gasket 168 and down side of floating gasket 168 and, consequently, higher hydraulic oil pressure at down side of floating gasket 168 relative to lower hydraulic oil pressure at up side of floating gasket 168 may urge floating gasket 168 move upward and stick to down side 1638 of hydraulic piston 163. In an exemplary embodiment, sticking floating gasket 168 to bottom surface 1638 of hydraulic piston 163 may block plurality of longitudinal through holes 1634 of hydraulic piston 163. In an exemplary embodiment, it may be understood that, when plurality of longitudinal through holes 1634 of hydraulic piston 163 are blocked, hydraulic oil communication may be prevented between up side 1636 of hydraulic piston 163 and down side 1638 of hydraulic piston 163. In an exemplary embodiment, hydraulic oil communication blockage between up side 1636 of hydraulic piston 163 and down side 1638 of hydraulic piston 163 may prevent downward movement of first connecting rod 164 along main axis 108.

In an exemplary embodiment, it may be understood that the first threshold speed and the second threshold speed may be correlated. In an exemplary embodiment, the second threshold speed may be a function of the first threshold speed based on shape of retractile element 102, length of first connecting rod 164, or any other parameters.

In an exemplary embodiment, the first threshold speed and the second threshold speed may be adjusted through adjusting one or more features of hydraulic mechanism 106. For example, the second threshold speed may be a function of hydraulic cylinder 162 length, hydraulic cylinder 162 inner diameter 1622, floating gasket 168 diameter, the fluid gap 1682 defined between fluid gasket 168 and hydraulic cylinder 162. For example, in an exemplary embodiment, a user may adjust the first threshold speed by changing the fluid gap 1682 defined between fluid gasket 168 and hydraulic cylinder 162.

In an exemplary embodiment, responsive to absence of an external force exerting onto first connecting rod 164, return spring 166 may push hydraulic cylinder 163 and first connecting rod 164 to move upward along main axis 108 until reach respectively a first position of hydraulic cylinder 163 and a first position of first connecting rod 164. In an exemplary embodiment, responsive to absence of the external force exerting onto first connecting rod 164, upward force of return spring 166 onto spring retainer 167 may overcome downward force of hydraulic oil pressure onto spring retainer 167 and consequently, spring retainer 167 may move upward and urge hydraulic cylinder 163 and first connecting rod 164 move upward.

For purpose of reference, return spring 166 and spring retainer 167 may provide a reset facility for hydraulic mechanism 106. In an exemplary embodiment, reset facility may refer to a mechanism that allow hydraulic mechanism 106 to return to hydraulic mechanism 106 initial configuration when a vehicle passed completely over the speed bump. In an exemplary embodiment, it may be understood that the first position of first connecting rod 164 may be the same as the position of first connecting rod 164 when no external force is exerted onto first connecting rod 164. And similarly, the first position of hydraulic cylinder 163 may be the same as the position of hydraulic cylinder 163 when no external force is exerted onto first connecting rod 164.

In an exemplary embodiment, hydraulic mechanism 106 may be substantially analogous, in features and functionality, to second hydraulic mechanism 300 which is shown in FIG. 3A.

FIG. 3A shows a perspective view of a second hydraulic mechanism 300, consistent with one or more exemplary embodiments of the present disclosure. In an exemplary embodiment, second hydraulic mechanism 300 may be utilized as hydraulic mechanism in retractable speed bump 100. As shown in FIG. 3, in an exemplary embodiment, alternative hydraulic mechanism 300 may include a hydraulic cylinder 302, a hydraulic piston 303, a first connecting rod 304, a return spring 305, and a gasket 306.

In an exemplary embodiment, hydraulic cylinder 302 may include a hollow wall 322 defining an shell oil reservoir 324. In an exemplary embodiment, hydraulic cylinder 302 may be in fluid communication with shell oil reservoir 324 through a plurality of holes 326. In an exemplary embodiment, hydraulic cylinder 302 may include a second pin insertion hole 1624 provided along a diameter of hydraulic cylinder 302.

In an exemplary embodiment, hydraulic piston 303 may be disposed slidably within hydraulic cylinder 302. In an exemplary embodiment, first connecting rod 304 may be attached fixedly to an upper surface 332 of hydraulic piston 303. In an exemplary embodiment, return spring 305 may be disposed on a bottom surface 328 of the hydraulic cylinder 302. In an exemplary embodiment, gasket 306 may be mounted onto return spring 305. In an exemplary embodiment, gasket 306 may define a gasket gap 362 between gasket 306 and interior surface of hydraulic piston 302.

In an exemplary embodiment, an outer diameter of hydraulic piston 303 may correspond to an inner diameter of hydraulic cylinder 302. For purpose of reference, it may be understood that the correspondence of outer diameter of hydraulic piston 303 and inner diameter of hydraulic cylinder 302 may provide a facility for fluid communication through a space between hydraulic piston 303 and hydraulic cylinder 302.

FIG. 3C shows a section-view of a second hydraulic mechanism when a vehicle passing over the speed bump slower than a threshold speed, consistent with one or more exemplary embodiments of the present disclosure.

In an exemplary embodiment, responsive to a vehicle passing over speed bump 100 slower than a first threshold speed, first connecting rod 304 and hydraulic piston 303 may move downward at a speed lower than the second threshold speed. As shown in FIG. 3C, in an exemplary embodiment, responsive to downward movement of hydraulic piston 303 at a speed below the second threshold speed, gasket 306 may maintain stationary. In an exemplary embodiment, it may be understood that gasket 306 may maintain stationary according to the fact that slow downward movement of hydraulic piston 303 may allow hydraulic oil go from up side of gasket 306 to down side of gasket 306 through gasket gap 362. In an exemplary embodiment, going hydraulic oil from up side of gasket 306 to down side of gasket 306 through gasket gap 362 may provide hydraulic oil communication between lower section 325 of hydraulic cylinder 302 and upper section 327 of hydraulic cylinder 302 through plurality of longitudinal through holes 326 and shell oil reservoir 324. In an exemplary embodiment providing hydraulic oil communication between lower section 325 of hydraulic cylinder 302 and upper section 327 of hydraulic cylinder 302 through plurality of longitudinal through holes 326 and shell oil reservoir 324 may allow downward movement of first connecting rod 304 and hydraulic piston 303.

FIG. 3D shows a section-view of a second hydraulic mechanism when a vehicle passing over the speed bump faster than a threshold speed, consistent with one or more exemplary embodiments of the present disclosure.

In an exemplary embodiment, responsive to a vehicle passing over speed bump 100 faster than the first threshold speed, first connecting rod 304 may move downward at a speed higher than the second threshold speed. In an exemplary embodiment, responsive to downward movement of first connecting rod 304 at a speed higher than a second threshold speed, gasket 306 may move downward and may stick to bottom surface 328 of hydraulic cylinder 302. In an exemplary embodiment, it may be understood that, gasket 306 may move downward and stick to bottom surface 328 of hydraulic cylinder 302 according to the fact that fast downward movement of hydraulic piston 303 may not allow sufficient hydraulic oil communication between up side of gasket 306 and down side of gasket 306 through gasket gap 362 and, consequently, higher hydraulic oil pressure at up side of gasket 306 relative to lower hydraulic oil pressure at down side of gasket 306 may urge gasket 306 move downward and stick to top surface 364 of hydraulic cylinder 302. In an exemplary embodiment, sticking gasket 306 to bottom surface 328 of hydraulic cylinder 302 may block plurality of holes 326 of hydraulic cylinder 302. In an exemplary embodiment, plurality of through holes 326 blockage may prevent fluid communication between lower section 325 of hydraulic cylinder 302 and upper section 327 of hydraulic cylinder 302 through plurality of holes 326 and shell oil reservoir 324. In an exemplary embodiment, preventing fluid communication between lower section 325 of hydraulic cylinder 302 and upper section 327 of hydraulic cylinder 302 through plurality of holes 326 and shell oil reservoir 324 may prevent downward movement of first connecting rod 304. In an exemplary embodiment, responsive to absence of an external force exerting onto first connecting rod 304, return spring 305 may push hydraulic cylinder 303 and first connecting rod 304 to move upward until reach respectively a first position of hydraulic cylinder 303 and a first position of first connecting rod 304. In an exemplary embodiment, it may be understood that responsive to absence of the external force exerting onto first connecting rod 304, upward force of return spring 305 onto gasket 306 may overcome downward force of hydraulic oil pressure onto gasket 306 and consequently, gasket 306 may move upward and urge hydraulic cylinder 303 and first connecting rod 304 move upward. It may be understood that the first position of first connecting rod 304 may be the same as the position of first connecting rod 304 when no external force is exerted onto first connecting rod 304. And similarly, the first position of hydraulic cylinder 303 may be the same as the position of hydraulic cylinder 303 when no external force is exerted onto first connecting rod 304. For purpose of reference, it may be understood that return spring 305 may provide a reset facility for second hydraulic mechanism. In an exemplary embodiment, reset facility may refer to a mechanism that allow second hydraulic mechanism to return to second hydraulic mechanism initial configuration when a vehicle passed completely over the speed bump.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study, except where specific meanings have otherwise been set forth herein. Relational terms such as "first" and "second" and the like may be used solely to distinguish one entity or action from another without necessarily requiring or implying any actual such relationship or order between such entities or actions. The terms "comprises," "comprising," or any other variation thereof, as used herein and in the appended claims are intended to cover a non-exclusive inclusion, encompassing a process, method, article, or apparatus that comprises a list of elements that does not include only those elements but may include other elements not expressly listed to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is not intended to be used to interpret or limit the scope or meaning of the claims. In addition, in the foregoing Detailed Description, it can be seen that various features are grouped together in various implementations. Such grouping is for purposes of streamlining this disclosure and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into this Detailed Description, with each claim standing on its own as a separately claimed subject matter.

While various implementations have been described, the description is intended to be exemplary, rather than limiting and it will be apparent to those of ordinary skill in the art that many more implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in the light of the attached claims and their equivalents. Also, various modifications and changes may be made within the scope of the attached claims.

What is claimed is:

1. A retractable speed bump, comprising:

a retractile element, the retractile element;

a chassis, the retractile element mounted on the chassis through a first pin mechanism; and a hydraulic mechanism connected to the retractile element through a second pin mechanism, the hydraulic mechanism comprising:

a hydraulic cylinder comprising a hollow cylindrical shape;

a hydraulic piston connected to the retractile element through a connecting rod, the hydraulic piston comprising a solid cylindrical shape; the hydraulic piston disposed slidably inside the hydraulic cylinder; and a floating gasket comprising a disk shape, the floating gasket disposed slidably inside the hydraulic cylinder, the floating gasket defining a fluid gap between the floating gasket and an interior surface of the hydraulic cylinder, wherein:

the hydraulic mechanism is configured to retract the retractile element responsive to a vehicle passing over the speed bump slower than a first threshold speed;

the hydraulic mechanism is configured to prevent retracting the retractile element responsive to a vehicle passing over the speed bump faster than the first threshold speed;

the hydraulic piston comprising a plurality of longitudinal through holes along a main longitudinal axis of the hydraulic piston, the plurality of longitudinal through holes configured to provide hydraulic oil communication between an upper section of the hydraulic cylinder and a lower section of the hydraulic cylinder, upper section of the hydraulic cylinder located at an upper side of the hydraulic piston and the lower section of the hydraulic cylinder located at a lower side of the hydraulic piston, each of the plurality of longitudinal through holes having a semicircular shape;

responsive to a vehicle passing over the speed bump slower than the first threshold speed, the connecting rod urges the hydraulic piston sliding downward slower than a second threshold speed and thereby the floating gasket maintains float in the down side of the hydraulic piston and thereby the hydraulic oil communication between the upper section of the hydraulic cylinder and the lower section of the hydraulic cylinder through the plurality of longitudinal through holes allows the hydraulic piston sliding downward and thereby the retractile element retracts;

responsive to a vehicle passing over the speed bump faster than the first threshold speed, the connecting rod urges the hydraulic piston sliding downward faster than the second threshold speed and thereby the floating gasket sticks to a bottom face of the hydraulic piston such that blocking the hydraulic oil communication between the up side of the hydraulic piston and the down side of the hydraulic piston by blocking the plurality of longitudinal holes and thereby prevents the hydraulic piston sliding downward and thereby the retractile element maintains raised; and the hydraulic mechanism further comprises a return spring disposed on a bottom end of the hydraulic cylinder and a spring retainer mounted onto the return spring, the return spring and the spring retainer configured to raise the hydraulic piston to a first position of the hydraulic piston and thereby raise the retractile element to an initial position of the retractile element responsive to removing the vehicle force exerted onto the retractile element.

2. The retractable speed bump of claim 1, wherein the retractile element comprises a raised surface in the shape of a triangular surface or a rounded surface.

3. The retractable speed bump of claim 1, wherein the first pin mechanism comprises:

a hollow cylindrical element comprising a longitudinal through hole along a main longitudinal axis of the hollow cylindrical element, the hollow cylindrical element attached fixedly to a first inner surface of a first plate of the chassis; and a first pin disposed slidably and rotatably inside the longitudinal through hole.

* * * * *